US007232635B2

(12) United States Patent
Kobayashi et al.

(10) Patent No.: US 7,232,635 B2
(45) Date of Patent: Jun. 19, 2007

(54) IMAGE FORMING METHOD, IMAGE FORMING APPARATUS, AND PROCESSING CARTRIDGE

(75) Inventors: Nobuaki Kobayashi, Hachioji (JP); Masao Asano, Tokyo (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/350,853

(22) Filed: Jan. 24, 2003

(65) Prior Publication Data

US 2003/0190547 A1 Oct. 9, 2003

(30) Foreign Application Priority Data

Feb. 4, 2002 (JP) ..... 2002-026649
Mar. 1, 2002 (JP) ..... 2002-055535

(51) Int. Cl.
*G03G 21/00* (2006.01)

(52) U.S. Cl. ..... 430/125; 430/133; 430/134; 399/174; 399/175; 399/176

(58) Field of Classification Search ..... 430/125, 430/133, 134; 399/174, 175, 176
See application file for complete search history.

(56) References Cited

U.S. PATENT DOCUMENTS

| | | | | |
|---|---|---|---|---|
| 4,618,559 | A * | 10/1986 | Yashiki | 430/134 |
| 5,008,706 | A * | 4/1991 | Ohmori et al. | 399/174 |
| 5,300,986 | A * | 4/1994 | Mishra et al. | 399/171 |
| 5,351,109 | A * | 9/1994 | Haneda | 399/175 |
| 5,363,176 | A * | 11/1994 | Ishihara et al. | 399/176 |
| 5,578,410 | A * | 11/1996 | Petropoulos et al. | 430/134 |
| 6,063,532 | A * | 5/2000 | Miyake | 430/56 |
| 6,296,980 | B1 * | 10/2001 | Oshiba et al. | 430/110.3 |
| 6,815,135 | B2 * | 11/2004 | Morikawa et al. | 430/66 |

FOREIGN PATENT DOCUMENTS

| | | |
|---|---|---|
| JP | 60-097361 | 5/1985 |
| JP | 63 11357 | 12/1988 |
| JP | 01-123243 | 5/1989 |
| JP | 01-321435 | 12/1989 |
| JP | 02-157847 | 6/1990 |
| JP | 03-050551 | 3/1991 |
| JP | 03 60782 | 3/1991 |
| JP | 04141663 | 5/1992 |

(Continued)

OTHER PUBLICATIONS

Borsenberger, Paul M. et al. Organic Photoreceptors for Imaging Systems. New York: Marcel-Dekker, Inc. (1993) pp. 6-17.*

(Continued)

*Primary Examiner*—Christopher RoDee
(74) *Attorney, Agent, or Firm*—Lucas & Mercanti, LLP

(57) ABSTRACT

A method of forming a toner image employing a photoreceptor is described. The photoreceptor comprises a photosensitive layer on a cylindrical conductive substrate, Formula (1) and Formula (2) are held, $$0<P\max<2P \quad \text{Formula (1)}$$

$$2\leqq(P\max/D)\times100\leqq50 \quad \text{Formula (2)}$$

wherein P (μm) is the average of the coating layer thickness in central section in the width direction of the photoreceptor, Pmax (μm) is average of the image forming region, and D (μm) is average of distance between point, at which said maximum value is obtained, and edge of the coating layer.

15 Claims, 13 Drawing Sheets

FOREIGN PATENT DOCUMENTS

| | | | |
|---|---|---|---|
| JP | 05-142789 | | 6/1993 |
| JP | 05142789 | | 6/1993 |
| JP | 06138670 | | 5/1994 |
| JP | 8-179521 | | 7/1996 |
| JP | 08314159 | A * | 11/1996 |
| JP | 09-160268 | | 6/1997 |
| JP | 09-281725 | | 10/1997 |
| JP | 09281725 | | 10/1997 |
| JP | 10207084 | | 8/1998 |
| JP | 11-160893 | | 6/1999 |
| JP | 11-194509 | | 7/1999 |
| JP | 11184100 | | 7/1999 |
| JP | 11194509 | | 7/1999 |
| JP | 11-327173 | | 11/1999 |
| JP | 2000-304244 | | 11/2000 |
| JP | 2000-347427 | | 12/2000 |

OTHER PUBLICATIONS

Diamond, Arthur S. (ed.) Handbook of Imaging Materials. New York: Marcel-Dekker, Inc. (1991) pp. 398-399.*

* cited by examiner

FIG. 2
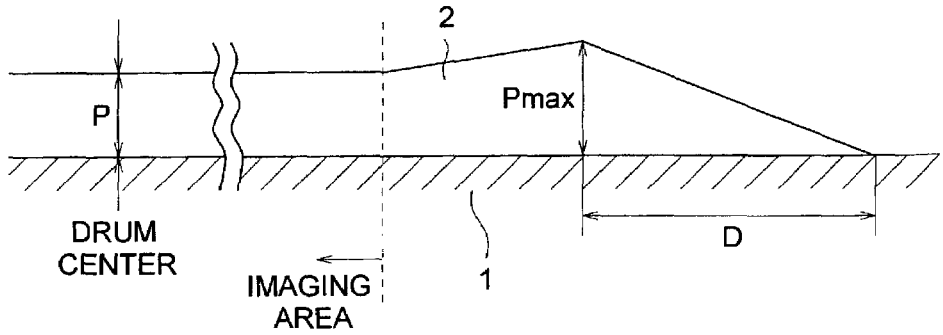
FIG. 3 ( a )
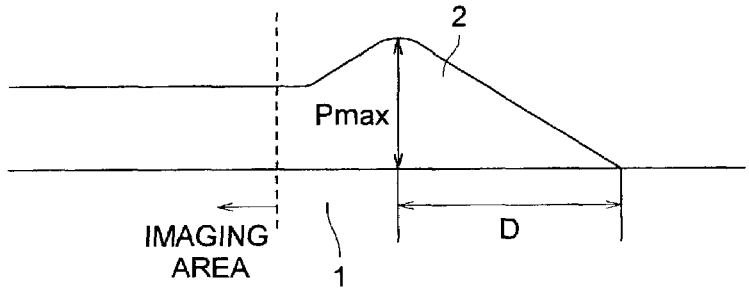
FIG. 3 ( b )
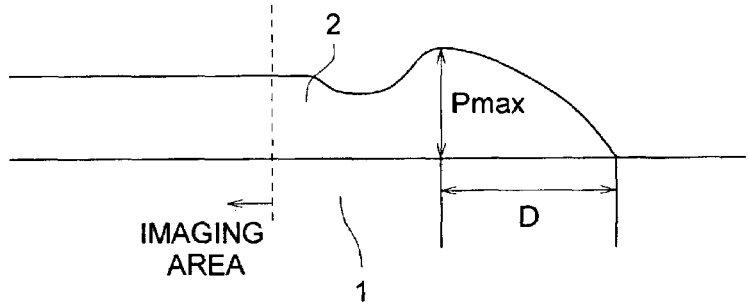
FIG. 3 ( c )
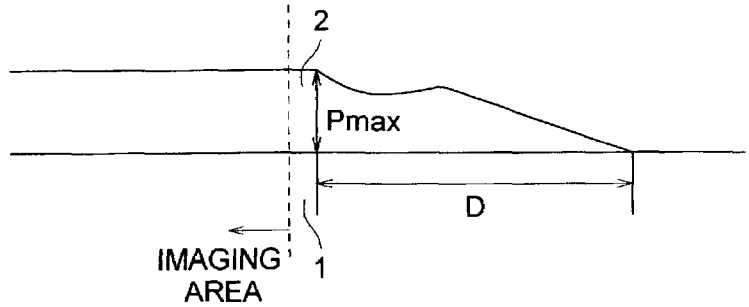

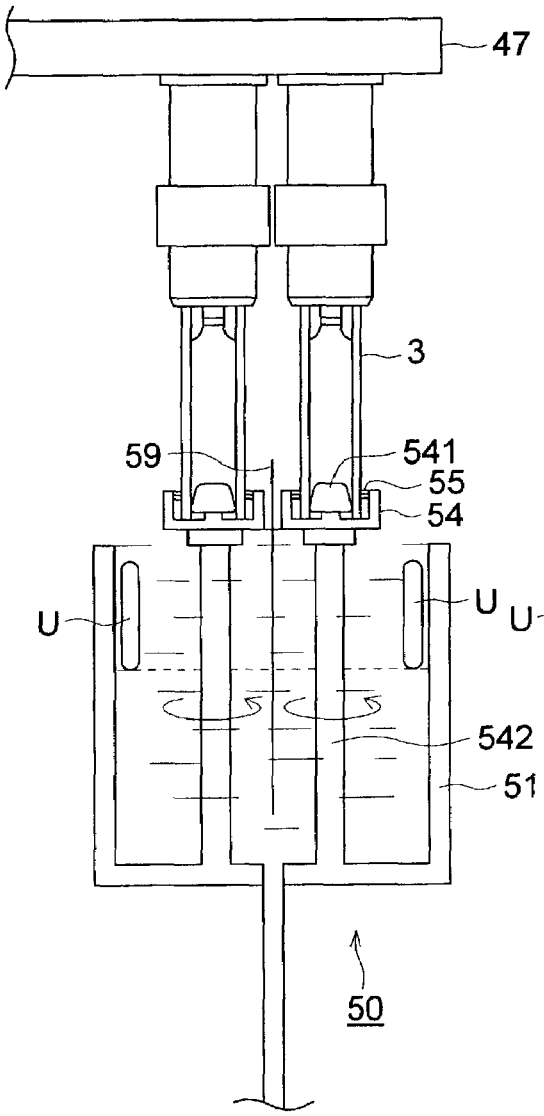
FIG. 8 (a)
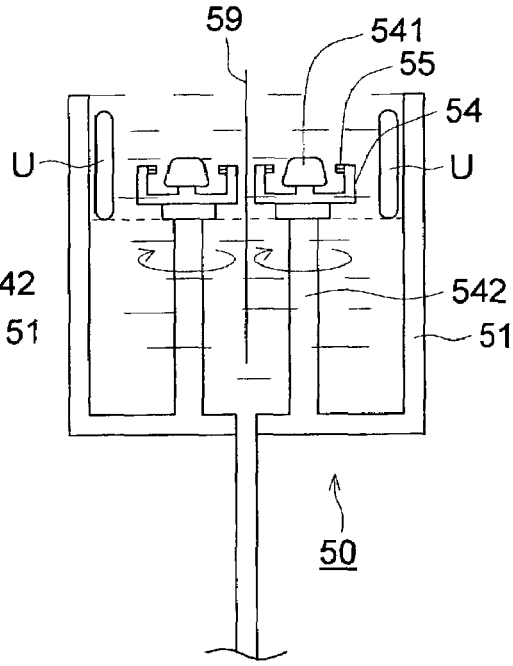
FIG. 8 (b)
FIG. 9
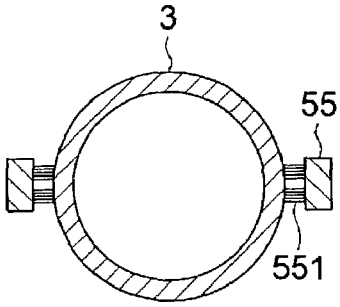

FIG. 10 ( a )
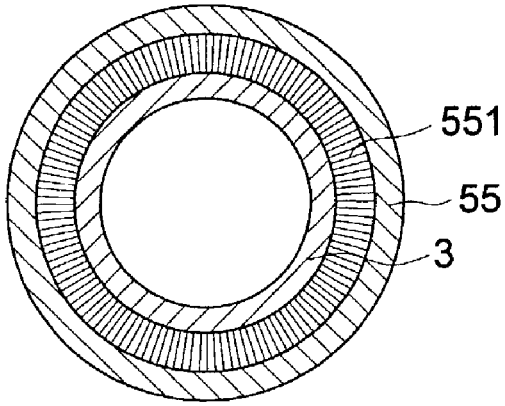
FIG. 10 ( b )
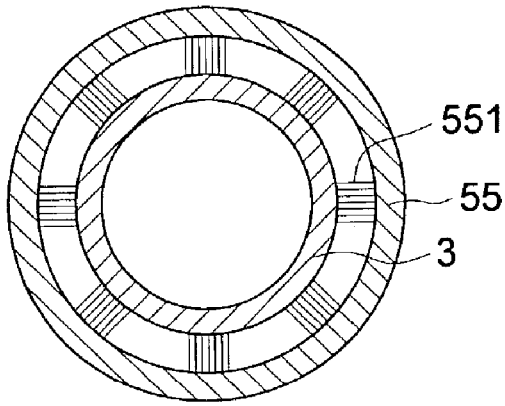
FIG. 10 ( c )
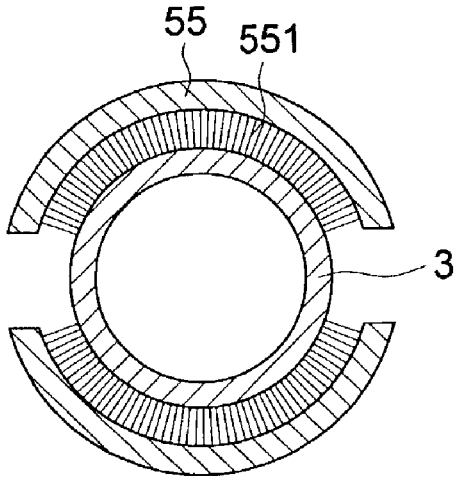

FIG. 12 ( a )
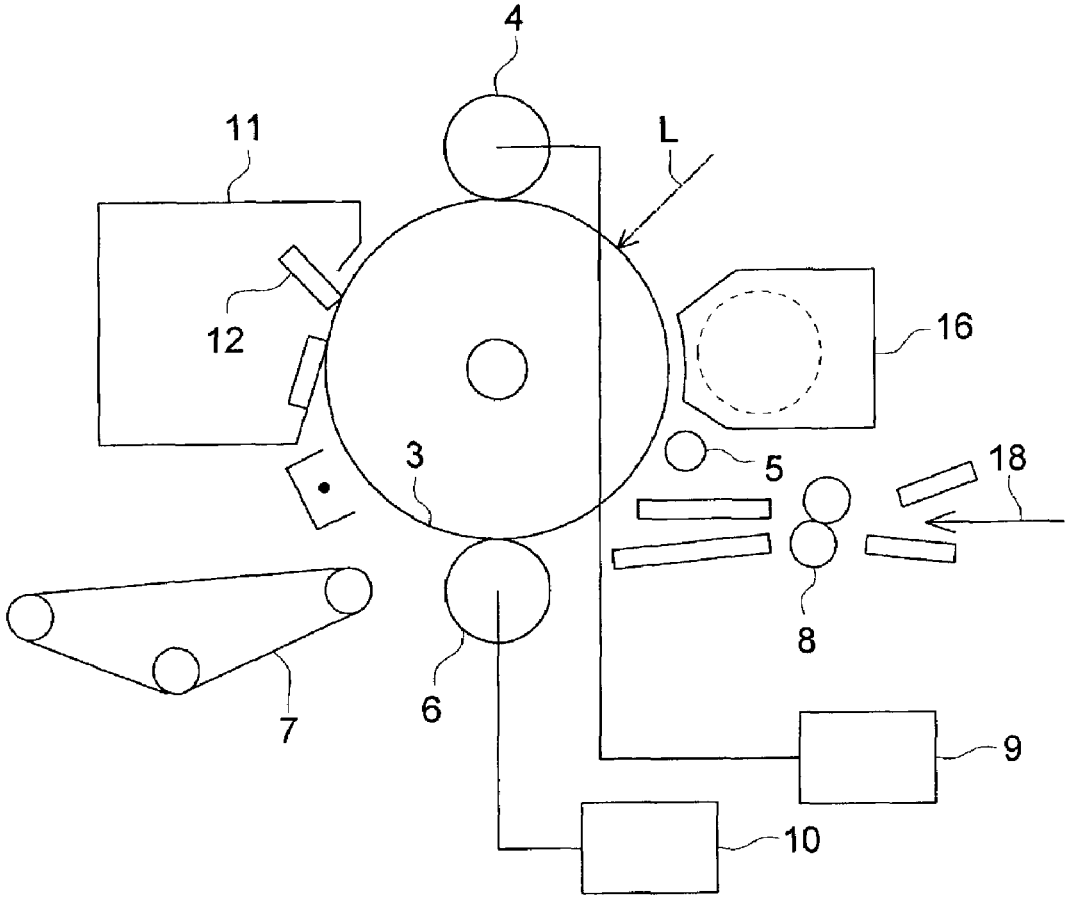
FIG. 12 ( b )
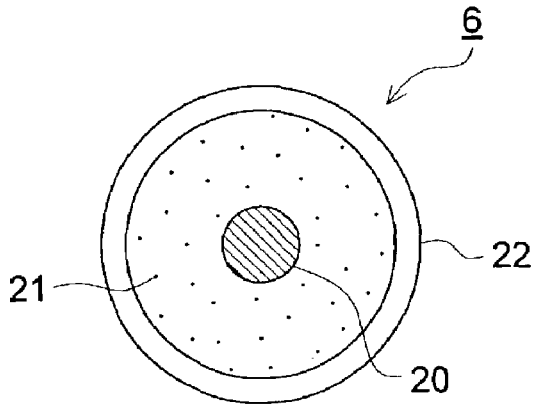

FIG. 18 ( a )
TONER HAVING NO CORNERS
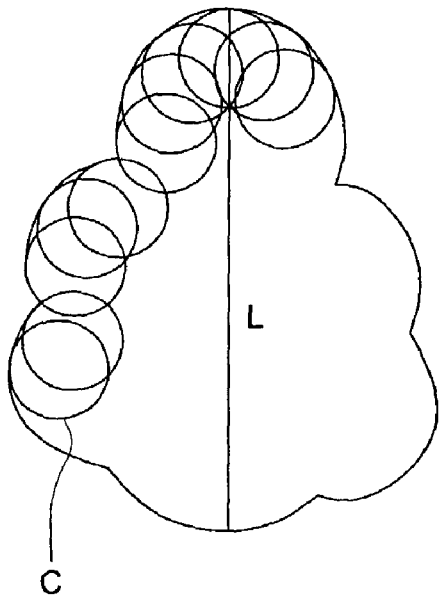
FIG. 18 ( b )
TONER HAVING CORNERS
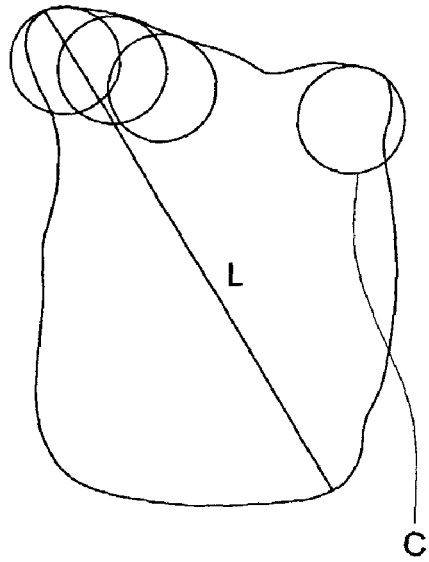
FIG. 18 ( c )
TONER HAVING CORNERS
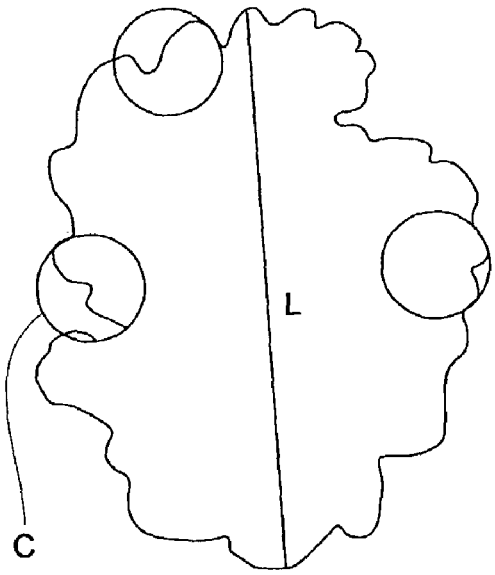

IMAGE FORMING METHOD, IMAGE FORMING APPARATUS, AND PROCESSING CARTRIDGE

FIELD OF THE INVENTION

The present invention relates to an image forming method, an image forming apparatus, and a processing cartridge which are employed in copiers, laser beam printers, and facsimile machines, and to an electrophotographic photoreceptor (hereinafter occasionally referred simply as a photoreceptor).

BACKGROUND OF THE INVENTION

When a cylindrical electrophotographic photoreceptor (hereinafter occasionally referred to as a photoreceptor drum) is produced, a coating layer is generally formed by immersing a conductive cylindrical substrate into into a photosensitive layer composition or coating compositions for an interlayer and a surface protective layer.

In such a case, since the conductive cylindrical substrate is immersed into a coating composition, a coating layer is formed on the entire surface of the conductive cylindrical body. When a photoreceptor drum, which is subjected to formation of the coating layer on the entire surface, is mounted on an electrophotographic image forming apparatus, occasionally, it becomes impossible to accurately carry out hitting due to peeling of the coating layer through contact with rollers which hits development units. Further, occasionally, it becomes impossible to use the photoreceptor drum as a contact point for grounding. As a result, it is preferable to remove the coating layer adhered on both edges of the photoreceptor drum.

Methods for removing such a coating layer include a method in which edges of a photoreceptor drum are immersed in a solvent and is subjected to vibration employing ultrasonic waves (Japanese Patent Application Open to Public Inspection No. 63-311357), a rubbing method employing a brush (Japanese Patent Application Open to Public Inspection Nos. 3-60782, 4-141663, 5-142789, 10-207084, 11-184100, and 11-194509), and in addition, a removing method employing tape.

For example, a method (Japanese Patent Application Open to Public Inspection No. 6-138670) is known in which tape which is comprised of thermally fusible type nonwoven fabric is successively unwound, and the resulting tape is impregnated with solvent and thereafter, the impregnated tape comes into contact with a photoreceptor drum, thereby the removal is carried out. A method (Japanese Patent Application Open to Public Inspection No. 9-281725) is also known in which tape comprised of nonwoven fabric, having an uneven structure on one surface, is employed.

Based on the investigations performed by the inventors of the present invention, however, in any methods, the following problems were found. Edges of the coating layer of a photoreceptor drum, in which the coating layer had been removed, tended to peel off. Insufficient cleaning occurred due to accumulation of toner at the edges in which the coating layer had been removed and toner scattering occurred, resulting in staining of the interior of the apparatus. Due to those, durability of the photoreceptor drum as well as cleaning member (such as cleaning means) degrades. As a result, it has been demanded that edges of the coating layer are shaped so that such problems do not occur.

Current electrophotographic image forming apparatuses, which are widely employed on the market, comprise at least charging, image exposure, development, transfer and cleaning means as well as a fixing means at the periphery of the electrophotographic photoreceptor as an image bearing body.

A charging member, which has been employed as a representative member for the aforesaid charging means, is a corona discharge unit. The corona charging unit exhibits advantages in which stable charging is carried out. However, since it is necessary to apply high voltage to the corona discharge unit, a large amount of ionized oxygen, ozone, moisture, and oxidized nitrogen compounds is generated. As a result, electrophotographic photoreceptors are degraded and human body may be advisedly affected.

Therefore, currently, it has been investigated to utilize a contact charging system instead of using the corona discharge unit. Specifically, a magnetic brush or a conductive roller is subjected to voltage application and subsequently comes into contact with a photoreceptor which is a charging body, whereby the photoreceptor surface is charged to the specified electric potential. When such a contact charging system is employed, it is possible to decrease voltage as well as an ozone generation amount, compared to the non-contact type charging system employing the corona discharge unit.

Accordingly, the contact charging units, which decrease the amount of ozone generation, have been increasingly employed. However, since the photoreceptor surface is subjected to abrasion, during repeated image formation, the photosensitive layer is abraded, whereby excessive rubbing as well as peeling at the edges of the coating layer occurs.

Particularly, during the repeated use at high temperature and high humidity, toner is adhere-accumulated at the edges of the photoreceptor, whereby the torque between the cleaning blade and the photoreceptor varies, resulting in peeling of the coating layer at edges. Particularly, when peeling occurs, or coagulated toner which adheres to the aforesaid portion is mixed with developer as foreign matter, insufficient charging as well as insufficient cleaning results in black spots, whereby image quality is occasionally degraded.

Particularly, in recent years, in order to utilize excellent image quality which is an advantage of the electrophotographic image forming method, and to further improve the image quality, development toner, comprised of smaller size particles with uniform shape, has been commonly employed. In such cases, the aforesaid problems are more pronounced.

SUMMARY OF THE INVENTION

An object of the present invention is to provide means in which even though toner comprised of small diameter particles with uniform shape is used, the aforesaid problems do not occur and it is possible to result in excellent image quality which is an advantage of the toner comprised of small diameter particles with uniform shape.

Another object of the present invention is to provide an electrophotographic image forming method, an image forming apparatus, and a processing cartridge in which irrespective of excellent image quality, edges of a photoreceptor coating layer result in no peeling due to sufficient adhesion, toner results in no accumulation, toner filming does not occurs, toner staining does not occur due to scattering of coating layer powder and toner, problems such as black spots do not occur, and excellent durability is exhibited, and an electrophotographic photoreceptor employed for the same.

The present invention and the embodiments thereof will now be described.

A method of forming a toner image, comprising:

electrically charging a photoreceptor;

imagewise exposing the photoreceptor so that a latent image is formed on the photoreceptor;

developing the latent image with toner so that a toner image is formed on the photoreceptor;

transferring the toner image on an image forming material; and removing a residual toner on said electrophotographic photoreceptor; wherein electrically charging a photoreceptor is conducted by a charging member being brought into contact with the photoreceptor, and the photoreceptor comprises a photosensitive layer on a cylindrical conductive substrate, Formula (1) and Formula (2) are held, $$0<P\max<2P \quad \text{Formula (1)}$$

$$2\leqq(P\max/D)\times100\leqq50 \quad \text{Formula (2)}$$

wherein P (μm) is the average of the coating layer thickness in central section in the width direction of the photoreceptor, Pmax (μm) is average of the maximum value of the layer thickness out of the image forming region, and D (μm) is average of distance between point, at which said maximum value is obtained, and edge of the coating layer.

The toner employed in the invention preferably satisfies the following condition.

The variation coefficient of said shape coefficient is not more than 16 percent.

A number ratio of toner particles having a shape coefficient of 1.2 to 1.6 and is at least 65 percent.

A number ratio of toner particles having no corners is 50 percent or more.

A number variation coefficient in the toner number size distribution is not more than 27 percent.

In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class. D is diameter of toner particles (in μm).

The charging member is preferably a charging roller or a magnetic brush, and more preferably a magnetic brush.

The photoreceptor has a layer which is preferably prepared by coating a composition comprising a photosensitive material and removing a part of the layer.

A part of the photosensitive layer is removed preferably by making a rubbing means brought into contact with the photosensitive layer.

Preferable rubbing means is a brush or a tape.

The residual toner on said electrophotographic photoreceptor is removed preferably by urethane blade cleaning means.

Other embodiments of the invention are described.

An image forming method employing a photoreceptor and comprising a charging process, an exposure process, a development process employing a developer comprising toner, a toner transfer process, and a process to remove a residual toner on said electrophotographic photoreceptor employing as cleaning means, and the photoreceptor having at least a photosensitive layer on a cylindrical conductive substrate, which is brought into contact with a rubbing means to removal a part of the coating layer having an excess thickness, wherein both Formula (1) and Formula (2) described below are held and the variation coefficient of the shape factor of said toner is less than or equal to 16 percent.

$$0<P\max<2P \quad \text{Formula (1)}$$

$$2\leqq(P\max/D)\times100\leqq50 \quad \text{Formula (2)}$$

wherein P (μm) is the average of the coating layer thickness in the central section in the width direction of said photoreceptor, Pmax (μm) is the average of the maximum value of the layer thickness out of the image forming region, and D (μm) is the average of the distance between the point, at which said maximum value is obtained, and the edge of the coating layer.

A processing cartridge wherein any of at least a charging means, an exposure means, a development means, a transfer means, and a cleaning means are combined with an electrophotographic photoreceptor and is structured so as to be capable of being integrally and removably attached.

BRIEF DESCRIPTION OF THE DRAWINGS

FIG. 2 is a schematic enlarged cross-sectional view of the edge of a photosensitive layer.

FIG. 3 is a microscopic cross-sectional view showing a structure of the portion in which a photosensitive layer is peeled off by rubbing.

FIG. 8 is a cross-sectional view showing a coating layer removing apparatus employing a brush.

FIG. 9 is a cross-sectional view showing a contact state of a photoreceptor drum with a rubbing member.

FIG. 10 is a view showing one embodiment of a rubbing member.

FIG. 12 is a view showing a structure of one example of an image forming apparatus to which a charging roller is applied.

FIG. 18 is a view describing a toner particle without corners.

DETAILED DESCRIPTION OF THE INVENTION

Requisites and terms in the present invention will now be described. First, the coating layer, as described herein, refers all layers coated onto a cylindrical conductive substrate, as required, such as a photosensitive layer comprising a charge generating layer and a charge transport layer as a function separation type photoreceptor, an interlayer, and a surface protective layer.

An electrophotographic photoreceptor will now be described with reference to FIGS. 1(*a*), 1(*b*), and 1(*c*).

Figure 1:
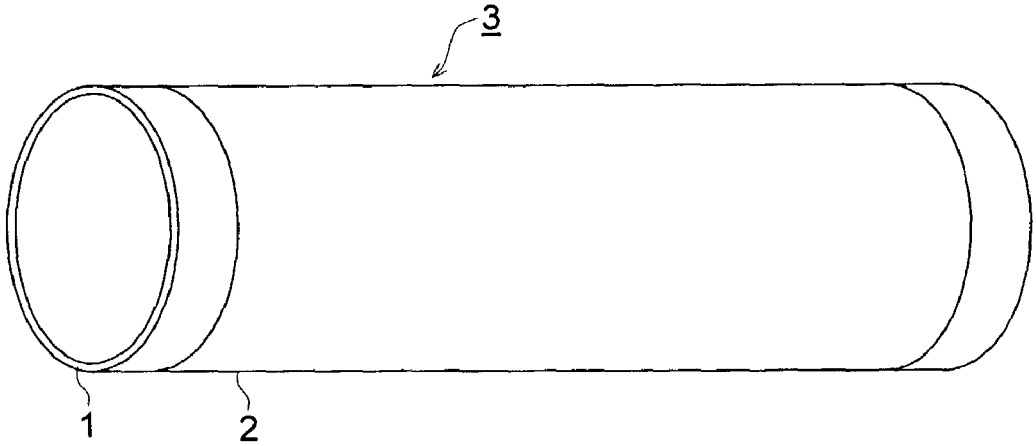
FIG. 1 is a view showing an electrophotographic photoreceptor drum and a view describing the specified values employed in the present invention.
Figure 1:
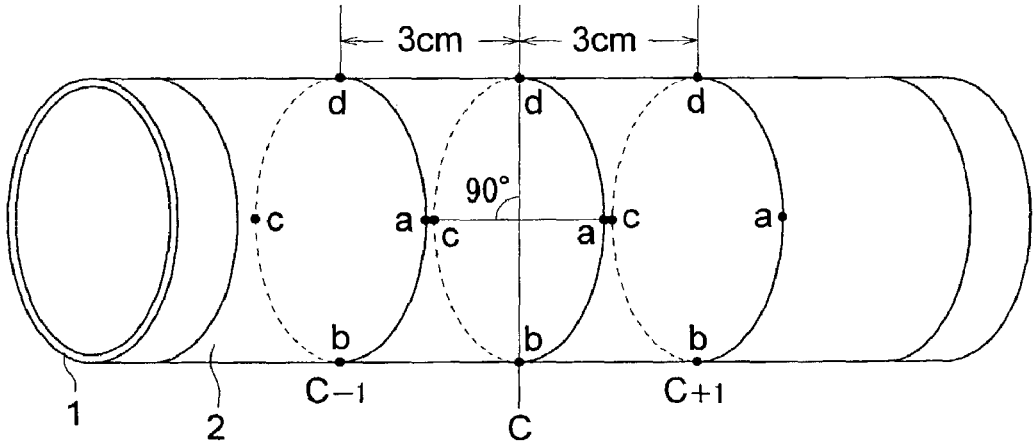
Figure 1:
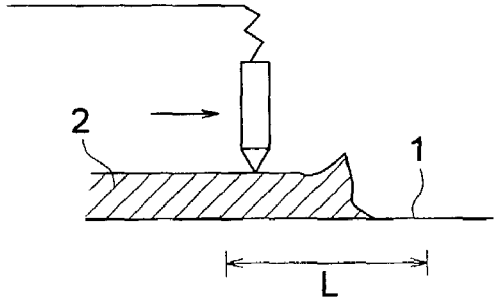

The photoreceptor drum employed in the present invention is shaped as shown in the perspective view of FIG. 1(*a*). A photosensitive layer and if desired, coating layers such as an interlayer and a surface protective layer are provided on the surface of drum shaped conductive substrate 1. It is necessary that both edges of the layer on the photoreceptor drum are completely peeled off and the edge shape is also critical.

A measurement method of average P (in μm) of the layer thickness in the central section of the photosensitive layer is described.

Average P of the layer thickness in the central section of the photosensitive layer will now be described with reference to FIG. 1(*b*). The thickness at 12 positions is measured, that is, positions a, b, c, and d, at the right angle with each other, of cross-section C in the center, and cross-sections $C_{-1}$ and $C_{+1}$, which are 3 cm apart from C. The resulting average is designated as average P of the layer thickness of the center section of the photosensitive layer. The aforesaid layer thickness was measured employing an eddy-current type layer thickness meter EDDY560C (manufactured by Helmut Fischer GMBT Co.).

The shape of the layer thickness of the coating layer edge was measured employing a continuous layer thickness measurement method described below.

As shown in FIG. 1(*c*), one edge of the coating layer to be measured is scanned. In such a case, as shown in FIG. 1(*c*), it is necessary that measurement length L includes the image forming region or the portion including the region of coating layer 2 having the same layer thickness as the image forming region and the exposed portion of conductive substrate 1. Practical measurement length L varies depending on the length of the conductive substrate, but is, for example, approximately 5 mm as standard.

In the same manner as shown in FIG. 1, 4 positions in the right angle with each other on the cross-section of the cylindrical conductive substrate are measured, and the resulting average is represented by Pmax. The distance to the edge of the coating layer is measured and the resultant average is represented by D. By plotting Pmax versus D, a profile is obtained as shower in FIG. 2. In addition, the other edge of the drum is measured in the same manner and the average is calculated. It is necessary that the values of each of both edges satisfy Formulas (1) and (2).

The aforesaid continuous layer thickness measurement was performed employing a layer thickness measurement apparatus Surfcom (manufactured by Kosaka Laboratory Ltd.), under the measurement mode of cross-section curve.

In practice, it is not easy that a coating layer is provided on the surface of a drum-shaped conductive substrate, and the surface of the conductive substrate is exposed by completely removing the coating layer at both edges. A method is developed in which the removal is carried out employing a solvent impregnated brush or tape. Methods will be detailed below. Even though these methods are employed, it has been found that problems occur.

Even though the coating layer is removed employing the aforesaid method, the resulting edge is shaped as shown by the schematic enlarged cross-sectional view in FIG. 2.

In FIG. 2, coating layer 2, such as a photosensitive layer and the like, is applied onto the surface of conductive substrate 1. Pmax is the average of the maximum layer thickness in the exterior of the image forming region (hereinafter occasionally referred to simply as an image region), and P is the average layer thickness of the central section of the drum. Further, D is the average distance from the Pmax position to the region in which the surface of the conductive substrate is exposed by completely peeling the coating layer (in the present invention, μm is employed as the unit).

As shown in FIG. 2, when the surface of the photoreceptor drum is microscopically viewed, the layer thickness of the photosensitive layer in the central section of the drum maintains uniform values and commonly exhibits the tentatively specified layer thickens of 15 to 50 μm. However, as approaching the portion at both edges which have been subjected to removal of the coating layer, the layer thickness becomes non-uniform. For example, as shown in FIG. 2, the thickness increases and then gradually decreases.

There are several shapes of the portion in which the photosensitive layer is removed by rubbing. FIG. 3 shows some of microscopic cross-sectional shapes as a reference. FIG. 3(*a*) shows a shape which is analogous to that described in FIG. 2. FIG. 3(*b*) shows a shape in which prior to reaching Pmax position from the uniform layer thickness section, the layer thickness becomes less than that of the uniform layer thickness section and subsequently, the layer thickness increases to Pmax larger than P, and then decreases gradually. FIG. 3(*c*) shows a shape in which even though the layer thickness does not decrease at a definite ratio, at the edge of the photosensitive layer, there is no particular portion which exhibits larger layer thickness than P, the layer thickness gradually decreases, and finally the surface of the electronically conductive substrate is exposed.

Figure 4:
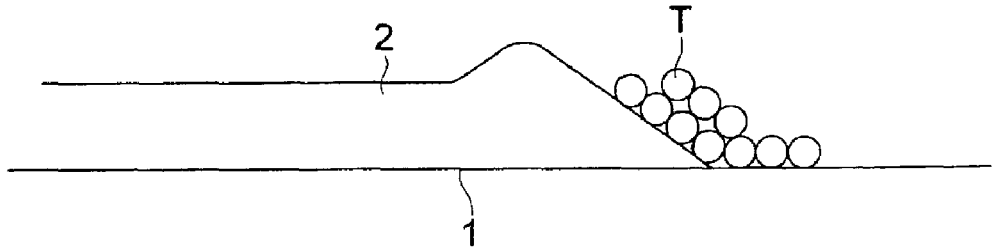
FIG. 4 is a conceptual cross-sectional view showing a state of toner particle accumulation or of adhesion of coagulated materials.

It is not known that these shapes are formed under any specified rubbing and removing conditions. However, problems occur due to excessive shape variations of the portion. Reasons are as follows. As shown in the schematic cross-sectional view of FIG. 4, in this portion, toner accumulates or coagulated materials adhere, and further, the coating layer peels off from this portion, resulting in various types of problems. Namely, it is seen that toner T adheres to the edge of coating layer 2. Further, it is definitely seen that this tends to occur as Pmax value increases and Pmax/D value increases.

Figure 5:
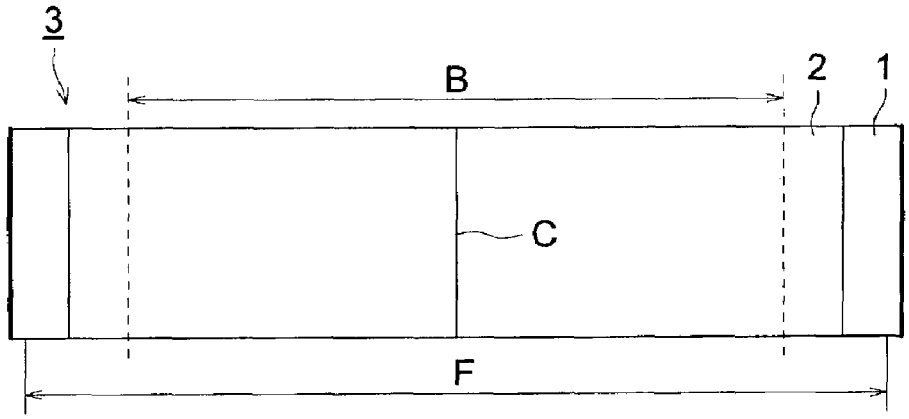
FIG. 5 is a view showing the cleaning region of a photoreceptor drum.

Reasons will be described utilizing the case of cleaning. As shown in FIG. 5, it will be well understood when the cleaning region is taken into account.

Photoreceptor drum 3 comprises conductive substrate 1 having thereon coating layer 2. Of these, the portion, which is employed for image formation, is region B (an image forming region) which is subjected to contact or facing with the magnetic brush of the development unit. Further, the portion, which is subjected to cleaning, is region F which is brought into contact with cleaning members (in many cases, cleaning blades). Region B is within the region which does not exhibit effects of layer thickness variation due to removal of the coating layer, and region F includes the region in which the photosensitive layer is completely peeled off. Naturally, the photosensitive layer on the photoreceptor drum is wider than aforesaid region B and narrower than region F, and is coated to a certain position between those. As noticed above, the edge is affected by the removal of the coating layer and its layer thickness is locally varied resulting in non-uniform thickness. As the local variation of the edge increases, more toner adheres or the resulting portion tends to be peeled off due to stress given by the cleaning blade. As a result, problems tend to occur. C refers to the central section in the width direction of the electrophotographic photoreceptor drum.

This situation is the entirely same as for a charging roller and a charging brush in the charging process. The foregoing is easily understood when the aforesaid cleaning blade is replaced with the charging roller and the cleaning brush.

Generally, Pmax is from 10 to 60 μm, and P is from 15 to 35 μm. It is necessary that (Pmax/D)×100 is adjusted in 2 to 50. When Pmax exceeds 60 μm, peeling tends to occur and coating layer powder tends to be adhered onto the image section, whereby image problems tend to occur. When (Pmax/D)×100 is less than 2, production difficulties occur due to uneasy machining, while it exceeds 50, toner staining increases or adhesion of the edge of the coating layer to conductive substrate 1 lowers.

Described next will be the toner which is employed in the present invention. The toner employed in the invention preferably satisfies the following condition.

(1) The variation coefficient of said shape coefficient is not more than 16 percent.

(2) A number ratio of toner particles having a shape coefficient of 1.2 to 1.6 and is at least 65 percent.

(3) A number ratio of toner particles having no corners is 50 percent or more.

(4) In a number based histogram, in which natural logarithm lnD is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class. D is diameter of toner particles (in μm).

(5) A number variation coefficient in the toner number size distribution is not more than 27 percent.

The toner satisfying at least one of the above mentioned conditions (1) through (5) is preferably employed, and more preferably those satisfying all conditions (1) through (5) are employed.

The condition (1) through (5) to the toner is detailed.

Shape coefficient of toner is a shape coefficient of toner particles, showing roundness of toner particles, which is defined as follows.

$$\text{Shape coefficient}=[(\text{maximum diameter}/2)^2\times\pi]/\text{projection area}$$

wherein the maximum diameter means the maximum width of a toner particle obtained by forming two parallel lines between the projection image of said particle on a plane, while the projection area means the area of the projected image of said toner on a plane.

In the present invention, said shape coefficient was determined in such a manner that toner particles were photographed under a magnification factor of 2,000, employing a scanning type electron microscope, and the resultant photographs were analyzed employing "Scanning Image Analyzer", manufactured by JEOL Ltd. At that time, 100 toner particles were employed and the shape coefficient of the present invention was obtained employing the aforementioned calculation formula.

The polymerized toner of the present invention is that the number ratio of toner particles in the range of said shape coefficient of 1.2 to 1.6 is preferably at least 65 percent and is more preferably at least 70 percent.

By employing a toner having the number ratio of toner particles having a shape coefficient of 1.2 to 1.6 to at least 65 percent in combination with a photoreceptor having specific shape at the end potion above mentioned, resolution and cleaning characteristics are improved, generation of half-tone unevenness is prevented and therefore, good image with good sharpness is obtained.

Methods to control said shape coefficient are not particularly limited. For example, a method may be employed wherein a toner, in which the shape coefficient has been adjusted to the range of 1.2 to 1.6, is prepared employing a method in which toner particles are sprayed into a heated air current, a method in which toner particles are subjected to application of repeated mechanical forces employing impact in a gas phase, or a method in which a toner is added to a solvent which does not dissolve said toner and is then subjected to application of a revolving current, and the resultant toner is blended with a toner to obtain suitable characteristics. Further, another preparation method may be employed in which, during the stage of preparing a so-called polymerization method toner, the entire shape is controlled and the toner, in which the shape coefficient has been adjusted to 1.2 to 1.6, is blended with a common toner.

The polymerization toner is preferable in view of simple preparation and excellent uniformity of surface of he toner particles in comparison with the crushed toner.

The variation coefficient of the polymerized toner is calculated using the formula described below:

$$\text{Variation coefficient}=(S/K)\times 100 \text{ (in percent)}$$

wherein S represents the standard deviation of the shape coefficient of 100 toner particles and K represents the average of said shape coefficient.

Said variation coefficient of the shape coefficient is generally not more than 16 percent, and is preferably not more than 14 percent.

By employing the toner having variation coefficient of the shape coefficient to not more than 16 percent in combination with a photoreceptor having specific shape at the end portion, resolution and cleaning characteristics are improved, and therefore, good image having good sharpness with reduced uneven half-tone image is obtained.

Cleaning deficiency sometimes occurs when a cylindrical drum photoreceptor mentioned above is employed, and therefore the deficiency apt to cause reduction of resolution and generation of uneven half-tone image. The deficiency can be prevented and electrostatic photograph having good sharpness can be obtained by employing the toner having variation coefficient of the shape coefficient to not more than 16 percent.

In order to uniformly control said shape coefficient of toner as well as the variation coefficient of the shape coefficient with minimal fluctuation of production lots, the optimal finishing time of processes may be determined while monitoring the properties of forming toner particles (colored particles) during processes of polymerization, fusion, and shape control of resinous particles (polymer particles).

Monitoring as described herein means that measurement devices are installed in-line, and process conditions are controlled based on measurement results. Namely, a shape measurement device, and the like, is installed in-line. For example, in a polymerization method, toner, which is formed employing association or fusion of resinous particles in water-based media, during processes such as fusion, the shape as well as the particle diameters, is measured while sampling is successively carried out, and the reaction is terminated when the desired shape is obtained.

Monitoring methods are not particularly limited, but it is possible to use a flow system particle image analyzer FPIA-2000 (manufactured by TOA MEDICAL ELECTRONICS CO., LTD.). Said analyzer is suitable because it is possible to monitor the shape upon carrying out image processing in real time, while passing through a sample composition. Namely, monitoring is always carried out while running said sample composition from the reaction location employing a pump and the like, and the shape and the like are measured. The reaction is terminated when the desired shape and the like is obtained.

The number particle distribution as well as the number variation coefficient of the toner of the present invention is measured employing a Coulter Counter TA-11 or a Coulter Multisizer (both manufactured by Coulter Co.). In the present invention, employed was the Coulter Multisizer which was connected to an interface which outputs the particle size distribution (manufactured by Nikkaki), as well as on a personal computer. Employed as used in said Multisizer was one of a 100 μm aperture. The volume and the number of particles having a diameter of at least 2 μm were measured and the size distribution as well as the average particle diameter was calculated. The number particle distribution, as described herein, represents the relative frequency of toner particles with respect to the particle diameter, and the number average particle diameter as described herein expresses the median diameter in the number particle size distribution.

The number variation coefficient in the number particle distribution of toner is calculated employing the formula described below:

$$\text{Number variation coefficient}=(S/D_n)\times 100 \text{ (in percent)}$$

wherein S represents the standard deviation in the number particle size distribution and $D_n$ represents the number average particle diameter(in μm).

The number variation coefficient of the toner of the present invention is not more than 27 percent, and is preferably not more than 25 percent.

By employing a toner having the number variation coefficient to not more than 27 percent in combination with a photoreceptor having specific shape at the end portion as above mentioned, resolution and cleaning characteristics are improved, generation of half-tone unevenness is prevented and therefore, good image with good sharpness is obtained.

Cleaning deficiency sometimes occurs when a cylindrical drum photoreceptor is employed, and therefore the deficiency apt to cause reduction of resolution and generation of uneven half-tone image. The deficiency can be prevented and electrostatic photograph having good sharpness can be obtained by developing the latent image on the surface of the photoreceptor employing the toner having the number variation coefficient to not more than 27 percent. Methods to control the number variation coefficient of the present invention are not particularly limited. For example, employed may be a method in which toner particles are classified employing forced air. However, in order to further decrease the number variation coefficient, classification in liquid is also effective. In said method, by which classification is carried out in a liquid, is one employing a centrifuge so that toner particles are classified in accordance with differences in sedimentation velocity due to differences in the diameter of toner particles, while controlling the frequency of rotation.

Specifically, when a toner is produced employing a suspension polymerization method, in order to adjust the number variation coefficient in the number particle size distribution to not more than 27 percent, a classifying operation may be employed. In the suspension polymerization method, it is preferred that prior to polymerization, polymerizable monomers be dispersed into a water based medium to form oil droplets having the desired size of the toner. Namely, large oil droplets of said polymerizable monomers are subjected to repeated mechanical shearing employing a homomixer, a homogenizer, and the like to decrease the size of oil droplets to approximately the same size of the toner. However, when employing such a mechanical shearing method, the resultant number particle size distribution is broadened. Accordingly, the particle size distribution of the toner, which is obtained by polymerizing the resultant oil droplets, is also broadened. Therefore classifying operation may be employed.

A number ratio of toner particles having no corners is 50 percent or more, and preferably 70 percent of more.

By employing a toner having no corners is 50 percent or more in combination with a photoreceptor having specific shape at the end portion as above mentioned, resolution and cleaning characteristics are improved, generation of half-tone unevenness is prevented and therefore, good image with good sharpness is obtained.

Cleaning deficiency sometimes occurs when a cylindrical drum photoreceptor mentioned above is employed, and therefore the deficiency apt to cause reduction of resolution and generation of uneven half-tone image. The deficiency can be prevented and electrophotographic image having good sharpness can be obtained by developing the latent image on the surface of the photoreceptor by a developer employing the toner having.

The toner particles of the present invention, which substantially have no corners, as described herein, mean those having no projection to which charges are concentrated or which tend to be worn down by stress. Namely, as shown in FIG. 8(*a*), the main axis of toner particle T is designated as L. Circle C having a radius of L/10, which is positioned in toner T, is rolled along the periphery of toner T, while remaining in contact with the circumference at any point. When it is possible to roll any part of said circle without substantially crossing over the circumference of toner T, a toner is designated as "a toner having no corners". "Without substantially crossing over the circumference" as described herein means that there is at most one projection at which any part of the rolled circle crosses over the circumference. Further, "the main axis of a toner particle" as described herein means the maximum width of said toner particle when the projection image of said toner particle onto a flat plane is placed between two parallel lines. Incidentally, FIGS. 8(*b*) and 8(*c*) show the projection images of a toner particle having corners.

Toner having no corners is measured as follows. First, an image of a magnified toner particle is made employing a scanning type electron microscope. The resultant picture of the toner particle is further magnified to obtain a photographic image at a magnification factor of 15,000. Subsequently, employing the resultant photographic image, the presence and absence of said corners is determined. Said measurement is carried out for 100 toner particles.

Methods to obtain toner having no corners are not particularly limited. For example, as previously described as the method to control the shape coefficient, it is possible to obtain toner having no corners by employing a method in which toner particles are sprayed into a heated air current, a method in which toner particles are subjected to application of repeated mechanical force, employing impact force in a gas phase, or a method in which a toner is added to a solvent which does not dissolve said toner and which is then subjected to application of revolving current.

Further, in a polymerized toner which is formed by associating or fusing resinous particles, during the fusion terminating stage, the fused particle surface is markedly uneven and has not been smoothed. However, by optimizing conditions such as temperature, rotation frequency of impeller, the stirring time, and the like, during the shape controlling process, toner particles having no corners can be obtained. These conditions vary depending on the physical properties of the resinous particles. For example, by setting the temperature higher than the glass transition point of said resinous particles, as well as employing a higher rotation frequency, the surface is smoothed. Thus it is possible to form toner particles having no corners.

The polymerized toner, which is preferably employed in the present invention, is as follows. The diameter of toner particles is designated as E (in μm). In a number based histogram, in which natural logarithm lnE is taken as the abscissa and said abscissa is divided into a plurality of classes at an interval of 0.23, a toner is preferred, which exhibits at least 70 percent of the sum (M) of the relative frequency ($m_1$) of toner particles included in the highest frequency class, and the relative frequency ($m_2$) of toner particles included in the second highest frequency class.

In the present invention, the histogram, which shows said number based particle size distribution, is one in which natural logarithm lnD (wherein D represents the diameter of each toner particle) is divided into a plurality of classes at an interval of 0.23 (0 to 0.23, 0.23 to 0.46, 0.46 to 0.69, 0.69 to 0.92, 0.92 to 1.15, 1.15 to 1.38, 1.38 to 1.61, 1.61 to 1.84, 1.84 to 2.07, 2.07 to 2.30, 2.30 to 2.53, 2.53 to 2.76 . . . ). Said histogram is drawn by a particle size distribution analyzing program in a computer through transferring to said computer via the I/O unit particle diameter data of a sample which are measured employing a Coulter Multisizer under the conditions described below.

(Measurement Conditions)

(1) Aperture: 100 μm (2) Method for preparing samples: an appropriate amount of a surface active agent (a neutral detergent) is added while stirring in 50 to 100 ml of an electrolyte, Isoton R-11 (manufactured by Coulter Scientific Japan Co.) and 10 to 20 ml of a sample to be measured is added to the resultant mixture. Preparation is then carried out by dispersing the resultant mixture for one minute employing an ultrasonic homogenizer.

By adjusting the sum (M) of the relative frequency ($m_1$) and the relative frequency ($m_2$) to at least 70 percent, the dispersion of the resultant toner particle size distribution narrows. Thus, by employing said toner in an image forming process, it is possible to securely minimize the generation of selective development.

The diameter of the toner particles of the present invention is preferably between 3 and 8 μm in terms of the number average particle diameter. When toner particles are formed employing a polymerization method, it is possible to control said particle diameter utilizing the concentration of coagulants, the added amount of organic solvents, the fusion time, or further the composition of the polymer itself.

By adjusting the number average particle diameter from 3 to 8 μm, improved is the halftone image quality as well as general image quality of fine lines, dots, and the like.

The volume average particle diameter can be measured by Coulter Counter TA-II or Coulter Multisizer. The measurement was carried out by a laser diffraction particle diameter measuring apparatus SLAD 1100 manufactured by Shimadzu Corp.

In the present invention, the Coulter Multisizer was used, which was connected to a particle size distribution output interface (manufactured by Nikkaki), via a personal computer.

The toner particles each having small particle size and similar size and shape can be obtained by polymerizing a monomer(s) in an aqueous medium to form fine resin particles, and further, coagulating and fusing the fine resin particles in an aqueous medium.

Particle size of the toner particles can be controlled by selecting the concentration of the coagulating agent (or salting agent), amount of organic solvent to be added, fusing period, composition of polymers.

As for the toner according to the invention external additives are reside on a surface of the particles uniformly, and sharp charging distribution and high fluidity can be obtained. Consequently the toner is excellent in developing characteristics and fine line reproduction characteristics, and can give stabilized cleaning characteristics for long term.

As result of study in view of minute shape of each toner particles, it has been found that corner part of the toner particles becomes round and the part accelerates the embedding external additives and deteriorates charging quantity variation, fluidity and cleaning characteristics. The charging quantity of the toner particles becomes non-uniform since the external additives are embedded at the corner part when the charge is imparted to the toner by triboelectricity. The invention can be prevent the deterioration effectively.

Achieving means to control the edge shape of the photoreceptor of the present invention include methods which control tape materials, tape providing methods, tape edge shape, brush materials, solvent compositions, removal time, removed layer thickness, and the swelling state prior to removing the coating layer. Of these, when the swelling state prior to removal, tape providing methods, brush materials, and solvent types are controlled, the desired edge shape is relatively easily formed.

Solvents which are employed during removal of the present invention vary depending on the types of coating layers, but include, for example, ether based, alcohol based, chlorine based, and ketone based solvents such as tetrahydrofuran, methanol, chloroform, methylene chloride, MEK (methyl ethyl ketone), acetone, and the like, and mixtures thereof.

The embodiments of coating layer removal will now be described with reference to drawings.

(1) Removal Method Employing Wiping-Off Tape

Figure 6:
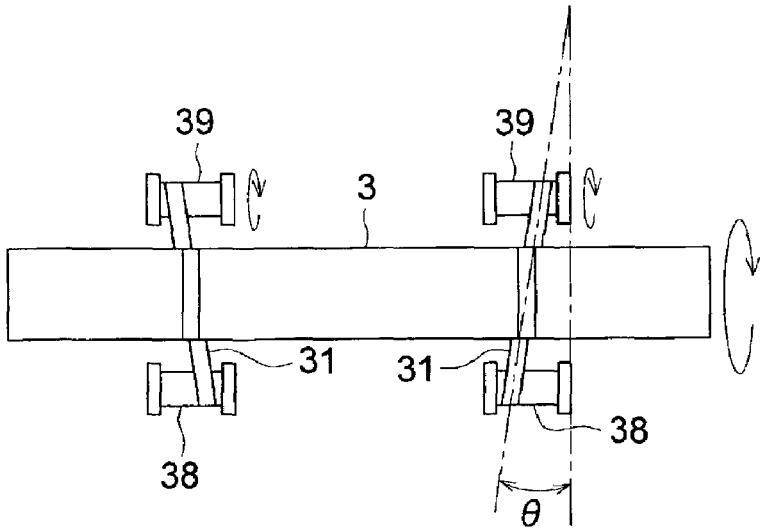
FIG. 6 is a schematic view showing that wiping-off tape is set on a photoreceptor drum while inclined.

FIG. 6 is a schematic view showing that wiping-off tape is set on a photoreceptor so as to form an inclination angle θ of at least 0 degree.

In FIG. 6, numeral 31 is the wiping-off tape, 3 is the photoreceptor drum, 38 is a master roller, 39 is a winding roller and, θ is an inclination angle.

The wiping-off tape is brought into contact with the edge of the photoreceptor drum. As shown in FIG. 5, the running direction of the aforesaid wiping-off tape is inclined so as to form an inclination angle θ of at least 0 degree with respect to the vertical plane to the longitudinal direction of photoreceptor drum 3. By so ding, it is possible that contact points between the wiping-off tape and the cross-section of the coating layer are minimized, and further, it is possible to wipe off pieces of the coating layer, which have been dissolved, so as not to be solidified at the edge. As a result, it is possible to smooth the edge without forming fins. By smoothing the edge, layer peeling from the edge is minimized and the formation of scars at the edge portion of the cleaning blade is also minimized.

<<Wiping-Off Tape>>

Materials for the wiping-off tape may be employed without any particular limitation, as long as they can be impregnated with employed solvents, are not damaged by the employed solvents, and can endure tension during wiping-off. Specifically employed are synthetic fiber such as polyamide based fiber including nylon 6 fiber and nylon 66 fiber, polyester based fiber including polyethylene terephthalate fiber and polybutylene terephthalate fiber, acryl based fiber, polyolefin based fiber such as binylon fiber, vinylidene fiber, polyurethane fiber, fluorine fiber, aromatic polyamide fiber, polyethylene fiber, and polypropylene fiber; regenerated fiber such as rayon fiber; semisynthetic fiber such as acetate fiber; inorganic fiber such as carbon fiber; plant fiber such as cotton fiber and bast fiber; and animal fiber such as wool.

<<Impregnating Solvents>>

Impregnating solvents which are employed for impregnating the wiping-off tape vary depending on the types of coating layers. However, they are not particularly limited as long as they can remove the coating layer while dissolving or swelling it. Employed as impregnating solvents may be those previously described.

A wiping-off method is a method in which the wiping-off tape is impregnated with solvents which dissolve or swell the coating layer and subsequently the resulting wiping-off tape comes into contact with the rotating photoreceptor drum, whereby the coating layer is wiped off.

The moving direction of the wiping-off tape is not particularly limited but is preferably the reverse direction against the rotation direction of the photoreceptor drum so that as wiping-off can be achieved over a short period.

Figure 7:
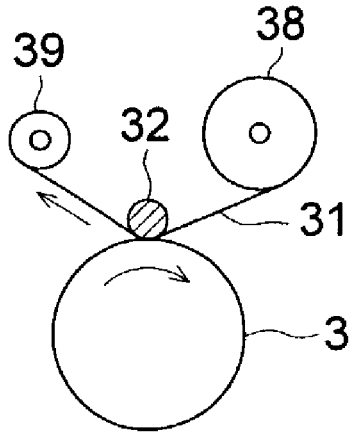
FIG. 7 is a schematic view showing an example of a method in which wiping-off tape is brought into contact with a photoreceptor drum.
Figure 7:
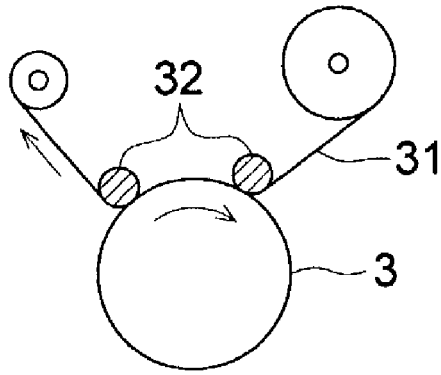
Figure 7:
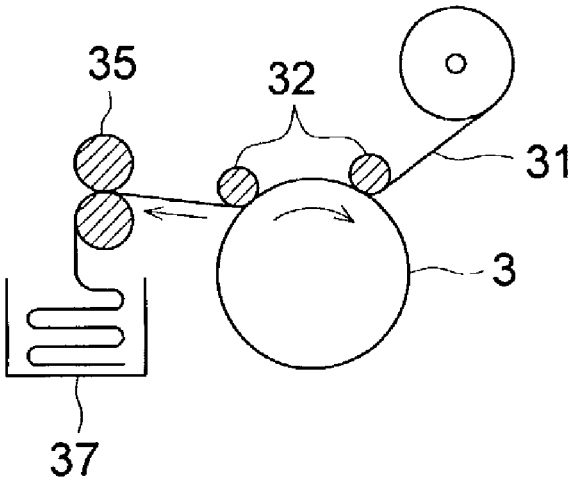

FIG. 7 is a schematic views showing one example of the method in which the wiping-off tape comes into contact with the photoreceptor drum.

Listed as specific methods in which the wiping-off tape comes into contact with the edge of the coating layer of the photoreceptor drum may be FIGS. 7(*a*), 7(*b*), and 7(*c*).

FIG. 7(*a*) shows a method in which wiping-off tape 31 is subjected to definite tension between master roll 38 and winding roll 39 and is brought into contact with photoreceptor drum 3, employing a pressure contact roller 32. In order that running direction of wiping-off tape 31 is inclined so as to form an inclination angle θ of at least 0 degree, as shown in FIG. 6, the installation position of master roll 38 may be shifted optionally from that of winding roll 39 so as to form the desired angle.

FIG. 7(*b*) shows a method in which two pressure contact rollers 32, which are used in FIG. 7(*a*), are employed and wiping-off tape 31 is brought into contact with the photoreceptor drum.

FIG. 7(*c*) shows a method in which winding roll 39 in FIG. 7(*a*) is replaced with nip drive roller 35 and wiping-off tape 31, which has completed wiping-off, is recovered in recovery container 37. Wiping-off tape 31, which has completed wiping-off, is impregnated with solvents. Therefore, it is preferable to place wiping-off tape 31 in the recovery container so that solvents are not vaporized into a room.

(2) Peeling Method Employing a Brush

FIG. 8 is a cross-sectional view of coating layer removing apparatus 50, employing a brush. In FIG. 8, numeral 3 is a photoreceptor in which a coating layer is formed on the surface. The photoreceptor drum is held employing transport means 47 so as to be movable up and down and is brought into contact with rubbing member 55 provided with coating layer removing stand 54 (a coating layer removing means) in the coating layer removing apparatus. Coating layer removing stand 54 is also provided with sponge-like substrate holding member 541, and the conductive substrate of the photoreceptor drum is held at the bottom end employing the substrate holding stand and the rubbing member. Further, coating layer removing stand 54 is structured to be rotatable utilizing motor drive. Photoreceptor drum 3 is installed in the specified position, employing transport means 47 comprising a holding means (such as an O ring chuck and an air picker chuck) which holds the interior of the substrate, and the bottom end of photoreceptor drum 3 is brought into contact with rubbing member 55 (FIG. 8a). In such a case, coating layer removing stand 54 is positioned above the liquid surface of solvent tank 51 which is a washing means. When residual solvents in the edge of the coating layer of the photoreceptor drum reaches less than or equal to 60 percent by weight, coating layer removing stand 54 starts rotating, and along with the rotation, the coating layer in the lower edge is wiped off by rubbing member 55. After wiping-off, the photoreceptor drum is lifted by transport means 47 (which also works as a separating means) and separated from coating layer removing stand 54. Thereafter, coating layer removing stand 54 is dipped (FIG. 8(*b*)) in solvents in solvent tank 51 which is a washing means, utilizing rotation of cylinder 542 (a moving means of the coating layer removing means) capable of moving coating layer removing stand 54 up and down, and the entire coating layer removing stand including the rubbing member is washed in the solvent tank, utilizing the combination of an ultrasonic cleaner, up and down movement and rotation of the coating layer removing stand, employing the cylinder. Subsequently, the coating layer removing stand is lifted over the liquid surface, again employing rotation of cylinder 542 and is prepared for the subsequent coating layer removal. It is preferable that washing efficiency of the coating layer removing means is enhanced by installing ultrasonic vibrator U in the solvent tank. As shown in FIG. 8, when the coating layers of at least two base bodies are simultaneously removed, it is preferable that partition 59 is provided between the coating layer removing means so that defect formation due to splash during peeling the coating layer of each of photoreceptor drums 3 is minimized.

Materials of the aforesaid rubbing members include brushes, sponges, cloths, and polymer fiber cloths. Of these, brushes are preferred.

The brush is preferably comprised of nylon, polyethylene, polypropylene, and polyester. When brush hairs are planted onto coating layer removing stand 54, the size of a single hole is from about 0.5 to about 2 mm, and the interval between holes is from about 1 to about 3 mm. It is preferable that the entire width of the brush is determined corresponding to the width of the coating layer to be removed.

The rubbing member impregnated with solvents, as described in the present invention, refers to the member which bears solvents, even though its materials are not impregnated with solvents. The weight of the rubbing member impregnated with solvents is preferably from 105 to 200 parts by weight when the weight of the rubbing member which is not impregnated with solvents is 100 parts by weight.

FIG. 9 is a longitudinal sectional view showing the contact state of photoreceptor drum 3 with rubbing member 55. Photoreceptor drum 3 is brought into contact with brush 551 of the rubbing member.

FIGS. 10(*a*), 10(*b*) and 10(*c*) each shows one structure of rubbing member 55.

Figure 11:
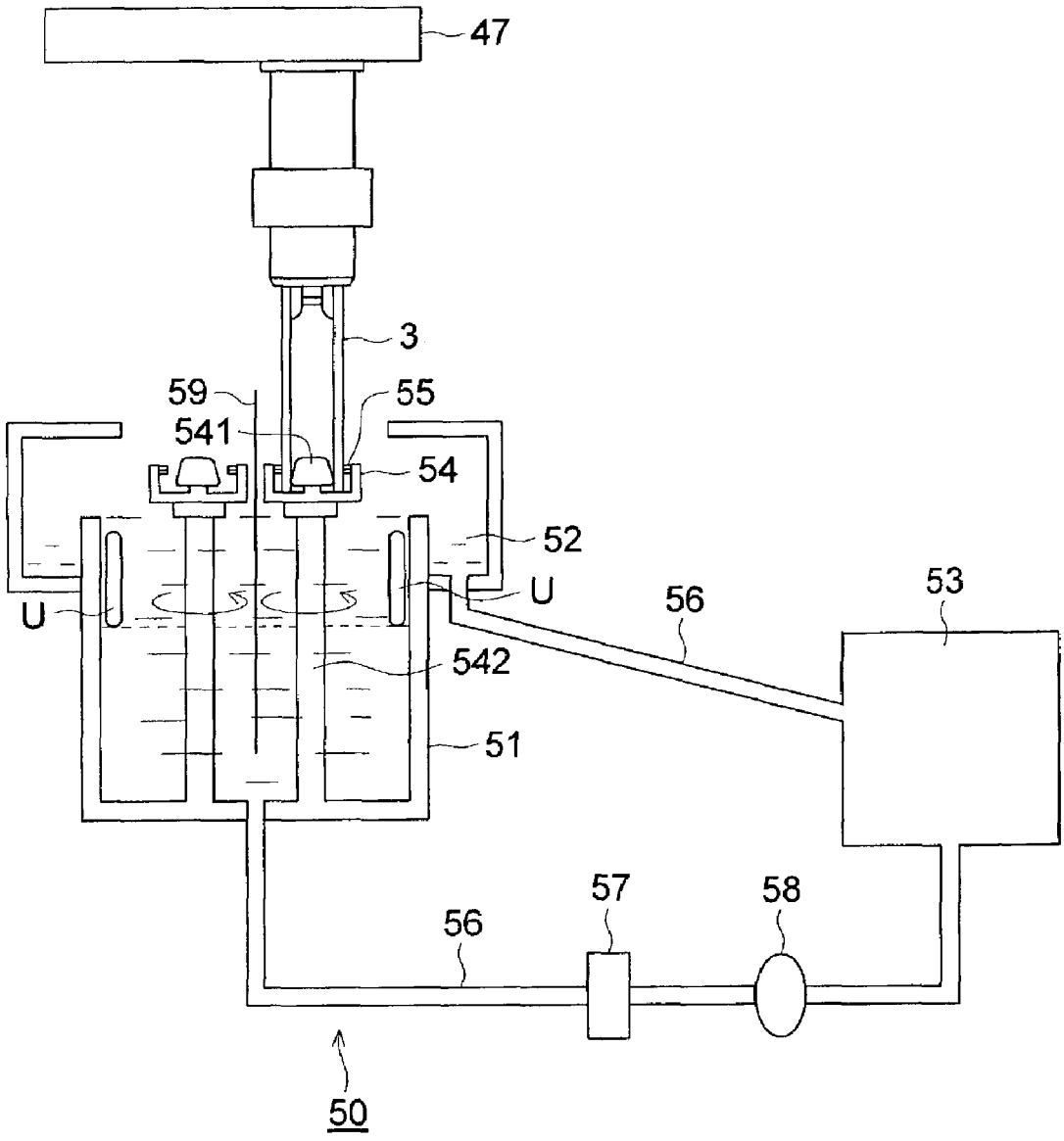
FIG. 11 is a view showing the entire structure of a coating layer removing apparatus.

FIG. 11 is a view showing the entire structure of coating layer removing apparatus 50.

Coating layer removing apparatus 50 is comprised of solvent tank 51, solvent overflow chamber 52, supply tank 53, coating layer removing stand 54, rubbing member 55, solvent circulation pipe 56, pump 57, filter 58, and transport means 47.

Coating layer removing stand 54 is attached with rubbing member 55 and substrate holding member 541. The photoreceptor drum is then firmly fixed and simultaneously, the rubbing member rotates being followed by rotation of coating layer removing stand 54, and the coating layer in the bottom edge of the photoreceptor drum is wiped off and removed. As shown in FIG. 11, coating layer removing stand 54 is structured so as to be movable to the interior as well as to the exterior of solvent tank 51 together with rubbing member 55, utilizing rotation of cylinder 542.

Further, solvents in the solvent tank is continuously circulated via solvent circulation pipe 56 from supply tank 53, and coating layer components are removed employing a filter which is provided at the intermediate position along solvent circulation pipe 56 so that the solvents can sufficiently wash the coating layer removing means.

2. Structure of Photoreceptor (1) Conductive Substrate (Conductive Support)

Employed as a conductive substrate, which is used to prepare the photoreceptor of the present invention, is a cylindrical conductive support. The cylindrical conductive support, as described herein, refers to a cylindrical support which meets requirement capable of continuously forming images with its rotation. Conductive supports, which are in the range of a straightness of less than or equal to 0.1 mm and a deviation of less than or equal to 0.1 mm, are preferred. When the straightness as well as the deviation exceeds the aforesaid range, it is difficult to form desired images.

Employed as conductive supports may be metal drums comprised of aluminum or nickel, plastic drums which are subjected to vacuum evaporation of tin oxides or indium oxides, or paper-plastic drums coated with conductive materials. The specific resistance of conductive supports is preferably less than or equal to $10^3$ Ωcm.

(2) Interlayer

The interlayer (UCL) employed in the present invention is provided between the conductive substrate and the photosensitive layer in order to enhance the adhesion of the aforesaid support and the aforesaid photosensitive layer and to minimize charge injection from the aforesaid support. Listed as materials of the aforesaid interlayer are polyamide resins, vinyl chloride resins, vinyl acetate resins, and copolymers comprising at least two repeating units of these resins. Of these, preferred as resins capable of minimizing an increase in residual potential during repeated use are polyamide resins. Further, the thickness of the interlayer comprised of these resins is preferably from 0.01 to 2.00 μm.

Further, listed as an interlayer which is most preferably employed in the present invention is one which employs curing metal resins which are prepared by thermally curing organic metal compounds such as silane coupling agents and titanium coupling agents.

Further, listed as another preferable interlayer is one comprising titanium oxide as well as binder resins, which is prepared by dispersing titanium oxide in a binder resin solution and coating the resulting dispersion. The thickness of the interlayer using titanium oxide is preferably from 0.1 to 15.0 μm.

The preferable photosensitive layer structure of the organic photoreceptor of the present invention will now be described.

(3) Photosensitive Layer

The photosensitive layer of the photoreceptor of the present invention may be comprised of a single layer provided with a charge generating function as well as a charge transport function, which is applied onto the aforesaid subbing layer. However, a more preferable structure is that the function of the photosensitive layer is achieved by dividing the layer into a charge generating layer (CGL) and a charge transport Layer (CTL). By utilizing a structure in which functions are separated, it is possible to control an increase in residual potential during repeated use to the minimal level and also easy to control other electrophotographic characteristics so as to achieve targets. A photoreceptor for negative charging is preferably structured so that the charge generating layer (CGL) is provided on the subbing layer and thereon the charge transport layer (CTL). In a photoreceptor for positive charging, the order of the aforesaid layer structure is reversed. The most preferable photosensitive layer structure is a photosensitive structure for negative charging, having a function separating structure.

The photosensitive layer structure of the function separation photoreceptor for negative charging will now be described.

<<Charge Generating Layer>>

The charge generating layer of the present invention comprises charge generating materials and binder resins and is formed by dispersing the charge generating materials in the binder resin solution and subsequently coating the resulting dispersion.

Employed as charge generating materials may be phthalocyanine compounds, which are preferably titanyl phthalocyanine compounds as well as hydroxylgallium phthalocyanine compounds. Further, titanyl phthalocyanine compounds such as Y type and A type (β type) are preferred which are featured to have a main peak of Bragg angle 2θ with respect to Cu-kα characteristic X-ray (having a wavelength of 1.54 Å). Such oxytitanyl phthalocyanines are described in Japanese Patent Application Open to Public Inspection No. 10-069107. Further, these charge generating materials may be employed individually or in combination of at least two types and may be mixed with polycyclic quinones such as perylene pigments.

Listed as binder resins of the charge generating layer are, for example, polystyrene resins, polyethylene resins, polypropylene resins, acryl resins, methacryl resins, vinyl chloride resins, vinyl acetate resins, polyvinyl butyral resins, epoxy resins, polyurethane resins, phenol resins, polyester resins, alkyd resins, polycarbonate resins, silicone resins, melamine resins, copolymers (such as vinyl chloride-vinyl acetate copolymers and vinyl chlorides-vinyl acetate-maleic anhydride copolymers) comprising at least two of these resins, and polyvinylcarbazole resins, but the resins are not limited to these example.

It is preferable that the charge generating layer is formed in such a manner that a coating composition is prepared by dispersing charge generating materials in a solution prepared by dissolving binder resins in solvents while using a homogenizer; the resulting coating composition is coated at a definite layer thickness, employing a coater, and the resulting coating is dried.

Listed as solvents which are employed to dissolve binder resins employed for the charge generating layer and also employed for coating are, for example, toluene, xylene, methylene chloride, 1,2-dichloroethane, methyl ethyl ketone, cyclohexane, ethyl acetate, butyl acetate, methanol, ethanol, propanol, butanol, methyl cellosolve, ethyl cellosolve, tetrahydrofuran, 1,4-dioxane, 1,3-dioxolane, pyridine, and diethylamine, but the solvents are not limited to these examples.

Employed as means for dispersing charge generating materials may be ultrasonic homogenizers, ball mills, sand grinders, and homomixers, but the means are not limited to these examples.

Listed as coaters for forming the charge generating layer are dip coaters and ring coaters, but the coaters are not limited to these.

The blending ratio of charge generating materials to binder resins is preferably from 1 to 600 parts (hereinafter, "parts" is parts by weight) with respect to 100 parts of the binder resins, and is more preferably from 50 to 500 parts. The thickness of the charge generating layer varies depending on the characteristics of charge generating materials, the characteristics of binder resins, and the mixing ratio, but is preferably from 0.01 to 5.00 μm.

<<Charge Transport Layer>>

The charge transport layer of the present invention comprises charge transport materials as well as binder resins, and is formed by dissolving the charge transport materials in a binder resin solution and coating the resulting composition.

Employed as charge transport materials, other than those described in Japanese Patent Application No. 2000-360998, may be, for example, carbazole derivatives, oxazole derivatives, oxadiazole derivatives, thiazole derivatives, thiadiazole derivatives, triazole derivatives, imidazole derivatives, imidazolone derivatives, imidazoline derivatives, bisimidazoline derivatives, styryl compounds, hydrazone compounds, pyrazoline compounds, oxazolone derivatives, benzimidazole derivatives, quinazoline derivatives, benzofuran derivatives, acrydine derivatives, phenazine derivatives, aminostilbene derivatives, triarylamine derivatives, phenylenediamine derivatives, stilbene derivatives, benzidine derivatives, poly-N-vinylcarbazole, polt-1-vinylpyrene and poly-9-vinylanthrathene. These may be employed in combination of at least two types.

Listed as binder resins for the charge transport layer are polycarbonate resins, polyacrylate resins, polyester resins, polystyrene resins, styrene-acrylonitrile copolymer resins, polymethacrylic acid ester resins, and styrene-methacrylic acid ester copolymer resins. Of these, polycarbonates are preferred. Further, polycarbonates comprised of BPA, BPZ, dimethyl BPA, and BPA-dimethyl BPA copolymers are preferred from the viewpoint of cracking, abrasion resistance, and charging characteristics.

It is preferable that the charge transport layer is formed as follows. A coating composition is prepared by dissolving charge transport materials in binder resins. The resulting coating composition is coated so as to achieve a definite coating thickness, employing a coater, and subsequently dried.

Listed as solvents employed for dissolving aforesaid binder resins and charge transport materials are, for example, toluene, xylene, methylene chloride, 1,2-dichloroethane, methyl ethyl ketone, cyclohexanone, ethyl acetate, butyl acetate, methanol, ethanol, propanol, butanol, tetrahydrofuran, 1,4-dioxane, 1,3-dioxolane, pyridine, and diethylamine, but the solvents are not limited to these.

The blending ratio of the charge transport materials to the binder resins is preferably from 10 to 500 parts (hereinafter, "parts" is parts by weight) with respect to 100 parts of the binder resins, and is more preferably from 20 to 100 parts.

The thickness of the charge transport layer varies depending on the characteristics of charge transport materials, the characteristics of binder resins, the characteristics of binder resins, and the mixing ratio, but is preferably from 10 to 100 μm, and is more preferably from 15 to 40 μm.

Further, antioxidants (AO agents), electron accepting materials (EA agents), and stabilizers may be incorporated in the charge transport layer. AO agents are preferred which are described in Japanese Patent Application No. 11-200135, while EA agents are preferred which are described in Japanese Patent Publication Open to Public Inspection Nos. 50-137543 and 58-76483.

(4) Protective Layer

In order to enhance durability, the protective layer may be provided on the charge transport layer. The protective layer utilizing siloxane based resins, described in each of Japanese Patent Publication Open to Public Inspection Nos. 9-190004, 10-095787, and 2000-171990, is preferred due to enhancement of its abrasion resistance. In the foregoing, the most preferable layer structure of the organic photoreceptor is exemplified. However, in the present invention, layer structures other than those, described above, may be employed.

(2) Preparation of Toner Employed in the Invention

Described next will be the preparation of toner which is employed in the present invention.

Producing method of toner

The toner can be produced by various methods. It is preferred to employ so-called polymerization method, which does not require a pulverization or classifying step, so as to obtain toner particles having uniform size.

The method includes a process preparing fine resin particles by a suspension polymerization method, or an emulsion polymerization method or a mini-emulsion polymerization method, a process of adding required emulsifier in a certain step, and coagulation and fusing step of the fine resin particles by adding a coagulant such as an organic solvent or salts.

(1) Suspension Polymerization

When the toner is produced by the suspension polymerization method, the production is performed by the following procedure. Various raw materials such as a colorant, a mold releasing agent according to necessity, a charge controlling agent and a polymerization initiator are added into a polymerizable monomer and dispersed or dissolved by a homogenizer, a sand mill, a sand grinder or a ultrasonic dispersing apparatus. The polymerizable monomer in which the raw materials are dissolved or dispersed is dispersed into a form of oil drops having a suitable size as toner particle by a homo-mixer or a homogenizer in an aqueous medium containing a dispersion stabilizing agent. Then the dispersion is moved into a reaction vessel having a stirring device with double stirring blades, and the polymerization reaction is progressed by heating. After finish of the reaction, the dispersion stabilizing agent is removed from the polymer particles and the polymer particles are filtered, washed and dried to prepare a toner. In the invention, the aqueous medium is a medium containing at least 50% by weight of water.

(2) Emulsion Polymerization

The toner according to the invention can be also obtained by salting-off/coagulating fine resin particles. For example, the methods described in JP O.P.I. Nos. 5-265252, 6-329947 and 9-15904 are applicable.

The toner can be produced by a method by which dispersed particles of constituting material such as resin particles and colorant or fine particles constituted by resin and colorant are associated several by several. Such the method is realized particularly by the following procedure: the particles are dispersed in water and the particles are salted-out by addition of a coagulation agent in an amount of larger than the critical coagulation concentration. At the same time, the particles are gradually grown by melt-adhesion of the particles by heating at a temperature higher than the glass transition point of the produced polymer. The particle growing is stopped by addition of a large amount of water when the particle size is reached at the prescribed diameter. Then the surface of the particle is made smooth by heating and stirring to control the shape of the particles. The particles containing water in a fluid state are dried by heating. Thus the toner can be produced. In the foregoing method, an infinitely water-miscible solvent such as alcohol may be added together with the coagulation agent.

(3) Composite Resin Particles Obtained by Multi-Step Polymerization

An example of composite resin particles prepared by a multi-step polymerization method, which is a representative preparation method of toner by an emulsion polymerization. A area other than the outermost layer of the composite resin particle preferably contains a releasing agent.

The production process comprises mainly, for example, the following processes:

1. A multi-step polymerizing process to obtain a composite resin which contains a releasing agent in an area other than the outermost layer, i.e., core area or inter layer.
2. A salting-out/coagulation process to produce a toner particle by salting-out/coagulating the compound resin particles and colored particles.
3. Filtering and washing processes to filter the toner particles from the toner particle dispersion and to remove a unnecessary substance such as the surfactant from the toner particles.
4. A drying process to dry the washed toner particles.
5. A process to add an exterior additive to the toner particles.

Each of the processes is described more in detail below.

(Multi-Step Polymerization Process)

The multi-step polymerization process is a process for preparing the composite resin particle having covering layer of polymer on a resin particle.

It is preferred from the viewpoint of the stability and the anti-crush strength of the obtained toner to apply the multi-step polymerization including three or more polymerization steps.

The two- and tree-step polymerization methods, which are representative examples, are described below.

(Two-Step Polymerization Method)

The two-step polymerization method is a method for producing the composite resin particle comprised of the central portion (core) containing the crystalline material comprising the high molecular weight resin and an outer layer (shell) comprising the low molecular weight resin.

Practically a monomer liquid is prepared by incorporating the crystalline material in a monomer, the monomer liquid is dispersed in an aqueous medium (an aqueous solution of a surfactant) in a form of oil drop, and the system is subjected to a polymerization treatment (the first polymerization step) to prepare a dispersion of a higher molecular weight resin particles each containing the crystalline material.

Next, a polymerization initiator and a monomer to form the lower molecular weight resin is added to the suspension of the resin articles, and the monomer L is subjected to a polymerization treatment (the second polymerization step) to form a covering layer composed of the lower molecular weight resin (a polymer of the monomer) onto the resin particle.

(Three-Step Polymerization Method)

The three-step polymerization method is a method for producing the composite resin particle comprised of the central portion (core) comprising the high molecular weight resin, the inter layer containing the crystalline material and the outer layer (shell) comprising the low molecular weight resin.

Practically a suspension of the resin particles prepared by the polymerization treatment (the first polymerization step) according to a usual procedure is added to an aqueous medium (an aqueous solution of a surfactant) and a monomer liquid prepared by incorporating the crystalline material in a monomer is dispersed in the aqueous medium. The aqueous dispersion system is subjected to a polymerization treatment (the second polymerization step) to form a covering layer (inter layer) comprising a resin (a polymer of the monomer) containing the crystalline material onto the surface of the resin particle (core particle). Thus a suspension of combined resin (higher molecular weight resin-middle molecular weight resin) particles is prepared.

Next, a polymerization initiator and a monomer to form the lower molecular weight resin is added to the dispersion of the combined resin particles, and the monomer is subjected to a polymerization treatment (the third polymerization step) to form a covering layer composed of the low molecular weight resin (a polymer of the monomer) onto the composite resin particle.

In the three-step polymerization method, the crystalline material can be finely and uniformly dispersed by applying a procedure, at the time of forming the inter layer on the resin particle.

The polymer is preferably obtained by polymerization in the aqueous medium. The crystalline material is incorporated in a monomer, and the obtained monomer liquid is dispersed in the aqueous medium as oil drop at the time of forming resin particles (core) or covering layer thereon (inter layer) containing the crystalline material, and resin particles containing a releasing agent can be obtained as latex particles by polymerization treatment with the addition of initiator.

The water based medium means one in which from 50 to 100 percent by weight of water, is incorporated. Herein, components other than water may include water-soluble organic solvents. Listed as examples are methanol, ethanol, isopropanol, butanol, acetone, methyl ethyl ketone, tetrahydrofuran, and the like. Of these, preferred are alcohol based organic solvents such as methanol, ethanol, isopropanol, butanol, and the like which do not dissolve resins.

Methods are preferred in which dispersion is carried out employing mechanical force. The monomer solution is preferably subjected to oil droplet dispersion (essentially an embodiment in a mini-emulsion method), employing mechanical force, especially into water based medium prepared by dissolving a surface active agent at a concentration of lower than its critical micelle concentration. An oil soluble polymerization initiator may be added to the monomer solution in place of a part or all of water soluble polymerization initiator.

In the usual emulsion polymerization method, the crystalline material dissolved in oil phase tends to desorb. On the other hand sufficient amount of the crystalline material can be incorporated in a resin particle or covered layer by the mini-emulsion method in which oil droplets are formed mechanically.

Herein, homogenizers to conduct oil droplet dispersion, employing mechanical forces, are not particularly limited, and include, for example, CLEARMIX, ultrasonic homogenizers, mechanical homogenizers, and Manton-Gaulin homogenizers and pressure type homogenizers. The diameter of dispersed particles is 10 to 1,000 nm, and is preferably 30 to 300 nm.

Emulsion polymerization, suspension polymerization seed emulsion etc. may be employed as the polymerization method to form resin particles or covered layer containing the crystalline material. These polymerization methods are also applied to forming resin particles (core particles) or covered layer which do not contain the crystalline material.

The particle diameter of composite particles obtained by the process (1) is preferably from 10 to 1,000 nm in terms of weight average diameter determined employing an electrophoresis light scattering photometer ELS-800•(produced by OTSUKA ELECTRONICS CO., LTD.).

Glass transition temperature (Tg) of the composite resin particles is preferably from 48 to 74° C., and more preferably from 52 to 64° C.

The Softening point of the composite resin particles is preferably from 95 to 140° C.

Salting-Out/Fusion Process

Salting-out/fusion process is a process to obtain toner particles having undefined shape (aspherical shape) in which the composite resin particles obtained by the foregoing process and colored particles are aggregated.

Salting-out/fusion process of the invention is that the processes of salting-out (coagulation of fine particles) and fusion (distinction of surface between the fine particles) occur simultaneously, or the processes of salting-out and fusion are induced simultaneously. Particles (composite resin particles and colored particles) must be subjected to coagulation in such a temperature condition as lower than the glass transition temperature (Tg) of the resin composing the composite resin particles so that the processes of salting-out (coagulation of fine particles) and fusion (distinction of surface between the fine particles) occur simultaneously.

Particles of additives incorporated within toner particles such as a charge control agent (particles having average diameter from 10 to 1,000 nm) may be added as well as the composite resin particles and the colored particles in the salting-out/fusion process. Surface of the colored particles may be modified by a surface modifier.

The colored particles are subjected to salting out/fusion process in a state that they are dispersed in water based medium. The water based medium to disperse the colored particles includes an aqueous solution dissolving a surfactant in concentration not less than critical micelle concentration (CMC).

Homogenizers employed in the dispersion of the colored particles include, for example, CLEARMIX, ultrasonic homogenizers, mechanical homogenizers, and Manton-Gaulin homogenizers and pressure type homogenizers.

In order to simultaneously carry out salting-out and fusion, it is required that salting agent (coagulant) is added to the dispersion of composite particles and colored particles in an amount not less than critical micelle concentration and they are heated to a temperature of the glass transition temperature (Tg) or higher of the resin constituting composite particles.

Suitable temperature for salting out/fusion is preferably from (Tg plus 10° C.) to (Tg plus 50° C.), and more preferably from (Tg plus 15° C.) to (Tg plus 40° C.). An organic solvent which is dissolved in water infinitely may be added in order to conduct the salting out/fusion effectively.

(Filtration and Washing Process)

In the filtration and washing process, filtration is carried out in which said toner particles are collected from the toner particle dispersion, and washing is also carried out in which additives such as surface active agents, salting-out agents, and the like, are removed from the collected toner particles (a cake-like aggregate).

Herein, filtering methods are not particularly limited, and include a centrifugal separation method, a vacuum filtration method which is carried out employing Buchner funnel and the like, a filtration method which is carried out employing a filter press, and the like.

(Drying Process)

This process is one in which said washed toner particles are dried.

Listed as dryers employed in this process may be spray dryers, vacuum freeze dryers, vacuum dryers, and the like. Further, standing tray dryers, movable tray dryers, fluidized-bed layer dryers, rotary dryers, stirring dryers, and the like are preferably employed.

It is proposed that the moisture content of dried toners is preferably not more than 5 percent by weight, and is more preferably not more than 2 percent by weight.

Further, when dried toner particles are aggregated due to weak attractive forces among particles, aggregates may be subjected to crushing treatment. Herein, employed as crushing devices may be mechanical a crushing devices such as a jet mill, a Henschel mixer, a coffee mill, a food processor, and the like.

The toner according to the invention is preferably produced by the following procedure, in which the compound resin particle is formed in the presence of no colorant, a dispersion of the colored particles is added to the dispersion of the compound resin particles and the compound resin particles and the colored particles are salted-out and coagulated.

In the foregoing procedure, the polymerization reaction is not inhibited since the preparation of the compound resin particle is performed in the system without colorant. Consequently, the anti-offset property is not deteriorated and contamination of the apparatus and the image caused by the accumulation of the toner is not occurred.

Moreover, the monomer or the oligomer is not remained in the toner particle since the polymerization reaction for forming the compound resin particle is completely performed. Consequently, any offensive odor is not occurred in the fixing process by heating in the image forming method using such the toner.

The surface property of thus produced toner particle is uniform and the charging amount distribution of the toner is sharp. Accordingly, an image with a high sharpness can be formed for a long period. The anti-offset and anti-winding properties can be improved and an image with suitable glossiness can be formed while a suitable adhesiveness or a high fixing strength with the recording material or recording paper or image support in the image forming method including a fixing process by contact heating by the use of such the toner which is uniform in the composition, molecular weight and the surface property of the each particles.

Each of the constituting materials used in the toner producing process is described in detail below.

(3) Polymerizable Monomer

A hydrophobic monomer is essentially used as the polymerizable monomer for producing the resin or binder used in the invention and a cross-linkable monomer is used according to necessity. As is described below, it is preferable to contain at least one kind of a monomer having an acidic polar group and a monomer having a basic polar group.

Hydrophobic Monomer

The hydrophobic monomer can be used, one or more kinds of which may be used for satisfying required properties.

Practically, employed may be aromatic vinyl monomers, acrylic acid ester based monomers, methacrylic acid ester based monomers, vinyl ester based monomers, vinyl ether based monomers, monoolefin based monomers, diolefin based monomers, halogenated olefin monomers, and the like.

Listed as aromatic vinyl monomers, for example, are styrene based monomers and derivatives thereof such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrne, p-n-nonylstyrene, p-n-decylstyrene, p-n-dodecylstyrene, 2,4-dimethylstyrne, 3,4-dichlorostyrene, and the like.

Listed as (meth)acrylic acid and its ester bases monomers are methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethyl aminoethyl methacrylate, diethyl aminoethyl methacrylate, and the like.

Listed as vinyl ester based monomers are vinyl acetate, vinyl propionate, vinyl benzoate, and the like.

Listed as vinyl ether based monomers are vinyl methyl ether, vinyl ethyl ether, vinyl isobutyl ether, vinyl phenyl ether, and the like.

Listed as monoolefin based monomers are ethylene, propylene, isobutylene, 1-butene, 1-pentene, 4-methyl-1-pentene, and the like.

Listed as diolefin based monomers are butadiene, isoprene, chloroprene, and the like.

Listed as halogenated olefin based monomers are vinyl chloride, vinylidene chloride, vinyl bromide, and the like.

Crosslinking Monomers

In order to improve the desired properties of toner, added as crosslinking monomers may be radical polymerizable crosslinking monomers. Listed as radical polymerizable agents are those having at least two unsaturated bonds such as divinylbenzene, divinylnaphthalene, divinyl ether, diethylene glycol methacrylate, ethylene glycol dimethacrylate, polyethylene glycol dimethacrylate, phthalic acid diallyl, and the like.

Monomer Having an Acidic Polar Group

As the monomer having an acidic polar group, (a) an α,β-ethylenically unsaturated compound containing a carboxylic acid group (—COOH) and (b) an α,β-ethylenically unsaturated compound containing a sulfonic acid group (—$SO_3H$) can be cited.

Examples of said α,β-ethylenically unsaturated compound containing the carboxylic acid group (—COOH) of (a) include acrylic acid, methacrylic acid, fumaric acid, maleic acid, itaconic acid, cinnamic acid, maleic acid monobutyl ester, maleic acid mono-octyl ester and their sodium salts, zinc salts, etc.

Examples of said α,β-ethylenically unsaturated compound containing the sulfonic acid group (—$SO_3H$) of (b) include sulfonated styrene and its Na salt, allylsulfo succinic acid, allylsulfo succinic acid octyl ester and their sodium salts. Monomer having a basic polar group As the monomer having a basic polar group, can be cited (i) (meth)acrylic acid ester obtained by reacting (meth) acrylic acid with an aliphatic alcohol, which has 1 to 12 carbon atoms, preferably 2 to 8 carbon atoms, specifically preferably 2 carbon atoms, and which also has an amino group or a quaternary ammonium group, (ii) (meth)acrylic acid amide or (meth)acrylic acid amide having mono-alkyl group or di-alkyl group, having 1 to 18 carbon atoms, substituted on its N atom, (iii) vinyl compound substituted with a heterocyclic group having at least a nitrogen atom in said heterocyclic group, (iv) N,N-di-allyl-alkylamine or its quaternary salt. Of these, (meth)acrylic acid ester obtained by reacting (meth)acrylic acid with the aliphatic alcohol having the amino group or the quaternary ammonium group is preferred.

Examples of (meth)acrylic acid ester obtained by reacting (meth)acrylic acid with the aliphatic alcohol having the amino group or the quaternary ammonium group of (i) include dimethylaminoethylacrylate, dimethylaminoethylmethacrylate, diethylaminoethylacrylate, diethylaminoethylmethacrylate, quaternary ammonium salts of the above mentioned four compounds, 3-dimethylaminophenylacrylate and 2-hydroxy-3-methacryloxypropyl trimethylammonium salt, etc.

Examples of (meth)acrylic acid amide or (meth)acrylic acid amide having mono-alkyl group or di-alkyl group substituted on its N atom of (ii) include acrylamide, N-butylacrylamide, N,N-dibutylacrylamide, piperidylacrylamide, methacrylamide, N-butylmethacrylamide, N,N-dimethylacrylamide, N-octadecylacrylamide, etc.

Examples of vinyl compound substituted with a heterocyclic group having at least a nitrogen atom in said heterocyclic group of (iii) include vinylpyridine, vinylpyrrolidone, vinyl-N-methylpyridinium chloride, vinyl-N-ethylpyridinium chloride, etc.

Examples of N,N-di-allyl-alkylamine or its quaternary salt of (iv) include N,N-di-allyl-methylammonium chloride, N,N-di-allyl-ethylammonium chloride, etc.

Polymerization Initiators

Radical polymerization initiators may be suitably employed in the present invention, as long as they are water-soluble. For example, listed are persulfate salts (potassium persulfate, ammonium persulfate, and the like), azo based compounds (4,4'-azobis-4-cyanovaleric acid and salts thereof, 2,2'-azobis(2-amidinopropane) salts, and the like), peroxides, and the like.

Further, if desired, it is possible to employ said radical polymerization initiators as redox based initiators by combining them with reducing agents. By employing said redox based initiators, it is possible to increase polymerization activity and decrease polymerization temperature so that a decrease in polymerization time is expected.

It is possible to select any polymerization temperature, as long as it is higher than the lowest radical formation temperature of said polymerization initiator. For example, the temperature range of 50 to 90° C. is employed. However, by employing a combination of polymerization initiators such as hydrogen peroxide-reducing agent (for example, ascorbic acid), which is capable of initiating the polymerization at room temperature, it is possible to carry out polymerization at room temperature or higher.

Chain Transfer Agents

For the purpose of regulating the molecular weight of resin particles, it is possible to employ commonly used chain transfer agents.

The chain transfer agents, for example, employed are mercaptans such as octylmercaptan, dodecylmercaptan, tert-dodecylmercaptan, and the like. The compound having mercaptan are preferably employed to give advantageous toner having such characteristics as reduced smell at the time of thermal fixing, sharp molecular weight distribution, good preservation ability, fixing strength, anti-off-set and so on. The actual compounds preferably employed include ethyl thioglycolate, propyl thioglycolate, butyl thioglycolate, t-butyl thioglycolate, ethylhexyl thioglycolate, octyl thioglycolate, decyl thioglycolate, dodecyl thioglycolate, an ethyleneglycol compound having mercapto group, a neopentyl glycol compound having mercapto group, and a pentaerythritol compound having mercapto group. Among them n-octyl-3-mercaptopropionic acid ester is preferable in view of minimizing smell at the time of thermal fixing.

Surface Active Agents

In order to perform polymerization employing the aforementioned radical polymerizable monomers, it is required to conduct oil droplet dispersion in a water based medium employing surface active agents. Surface active agents, which are employed for said dispersion, are not particularly limited, and it is possible to cite ionic surface active agents described below as suitable ones.

Listed as ionic surface active agents are sulfonic acid salts (sodium dodecylbenzenesulfonate, sodium aryl alkyl polyethersulfonate, sodium 3,3-disulfondiphenylurea-4,4-diazo-bis-amino-8-naphthol-6-sulfonate, sodium ortho-caroxybenzene-azo-dimethylaniline-2,2,5,5-tetramethyl-triphenylmethane-4,4-diazi-bis-(-naphthol-6-sulfonate, and the like), sulfuric acid ester salts (sodium dodecylsulfonate, sodium tetradecylsulfonate, sodium pentadecylsulfonate, sodium octylsulfonate, and the like), fatty acid salts (sodium oleate, sodium laureate, sodium caprate, sodium caprylate, sodium caproate, potassium stearate, calcium oleate, and the like).

Further, it is possible to employ nonionic surface active agents. Specifically, it is possible to cite polyethylene oxide, polypropylene oxide, a combination of polypropylene oxide and polyethylene oxide, alkylphenol polyethylene oxide, esters of polyethylene glycol with higher fatty acids, esters of polypropylene oxide with higher fatty acids, sorbitan esters, and the like.

The resin particles preferably comprises "a high molecular weight resin" having a peak or a shoulder within the range of from 100,000 to 1,000,000, and "a low molecular weight resin" having a peak or a shoulder within the range of from 1,000 to 50,000, and more preferably "a middle molecular weight resin" having a peak or a shoulder within the range of from 15,000 to 100,000, in the molecular weight distribution.

Molecular weight of the resin composing toner is preferably measured by gel permeation chromatography (GPC) employing tetrahydrofuran (THF).

Added to 1 cc of THF is a measured sample in an amount of 0.5 to 5.0 mg (specifically, 1 mg), and is sufficiently dissolved at room temperature while stirring employing a magnetic stirrer and the like. Subsequently, after filtering the resulting solution employing a membrane filter having a pore size of 0.48 to 0.50 μm, the filtrate is injected in a GPC.

Measurement conditions of GPC are described below. A column is stabilized at 40° C., and THF is flowed at a rate of 1 cc per minute. Then measurement is carried out by injecting approximately 100 μl of said sample at a concentration of 1 mg/cc.

It is preferable that commercially available polystyrene gel columns are combined and used. For example, it is possible to cite combinations of Shodex GPC KF-801, 802, 803, 804, 805, 806, and 807, produced by Showa Denko Co., combinations of TSKgel G1000H, G2000H, G3000H, G4000H, G5000H, G6000H, G7000H, TSK guard column, and the like. Further, as a detector, a refractive index detector (IR detector) or a UV detector is preferably employed. When the molecular weight of samples is measured, the molecular weight distribution of said sample is calculated employing a calibration curve which is prepared employing monodispersed polystyrene as standard particles. Approximately ten polystyrenes samples are preferably employed for determining said calibration curve.

(Coagulants)

The coagulants selected from metallic salts are preferably employed in the processes of salting-out, coagulation and fusion from the dispersion of resin particles prepared in t e aqueous medium.

Listed as metallic salts, are salts of monovalent alkali metals such as, for example, sodium, potassium, lithium, etc.; salts of divalent alkali earth metals such as, for example, calcium, magnesium, etc.; salts of divalent metals such as manganese, copper, etc.; and salts of trivalent metals such as iron, aluminum, etc.

Some specific examples of these salts are described below. Listed as specific examples of monovalent metal salts, are sodium chloride, potassium chloride, lithium chloride; while listed as divalent metal salts are calcium chloride, zinc chloride, copper sulfate, magnesium sulfate, manganese sulfate, etc., and listed as trivalent metal salts, are aluminum chloride, ferric chloride, etc. Any of these are suitably selected in accordance with the application, and the two or three valent metal salt is preferable because of low critical coagulation concentration (coagulation point).

The critical coagulation concentration is an index of the stability of dispersed materials in an aqueous dispersion, and shows the concentration at which coagulation is initiated. This critical coagulation concentration varies greatly depending on the fine polymer particles as well as dispersing agents, for example, as described in Seizo Okamura, et al, Kobunshi Kagaku (Polymer Chemistry), Vol. 17, page 601 (1960), etc., and the value can be obtained with reference to the above-mentioned publications. Further, as another method, the critical coagulation concentration may be obtained as described below. An appropriate salt is added to a particle dispersion while changing the salt concentration to measure the ζ potential of the dispersion, and in addition the critical coagulation concentration may be obtained as the salt concentration which initiates a variation in the ζ potential.

The polymer particles dispersion liquid is processed by employing metal salt so as to have concentration not less than critical coagulation concentration. In this instance the metal salt is added directly or in a form of aqueous solution optionally, which is determined according to the purpose. In case that it is added in an aqueous solution the metal salt must satisfy the critical coagulation concentration including the water as the solvent of the metal salt.

The concentration of coagulant may be not less than the critical coagulation concentration. However, the amount of the added coagulant is preferably at least 1.2 times of the critical coagulation concentration, and more preferably 1.5 times.

Colorants

The toner is obtained by salting out/fusing the composite resin particles and colored particles.

Listed as colorants which constitute the toner of the present invention may be inorganic pigments, organic pigments, and dyes.

Employed as said inorganic pigments may be those conventionally known in the art. Specific inorganic pigments are listed below.

Employed as black pigments are, for example, carbon black such as furnace black, channel black, acetylene black, thermal black, lamp black, and the like, and in addition, magnetic powders such as magnetite, ferrite, and the like.

If desired, these inorganic pigments may be employed individually or in combination of a plurality of these. Further, the added amount of said pigments is commonly between 2 and 20 percent by weight with respect to the polymer, and is preferably between 3 and 15 percent by weight.

The magnetite can be incorporated when the toner is employed as a magnetic toner. In this instance from 20 to 60 weight percent of the magnetite is incorporated in view of sufficient magnetic characteristics.

Various organic pigments and dyes may be employed. Specific organic pigments as well as dyes are exemplified below.

The organic pigment or organic dye is also employed, examples thereof are listed.

Listed as pigments for magenta or red are C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, and the like.

Listed as pigments for orange or yellow are C.I. Pigment Orange 31, C.I. Pigment Orange 43, C.I. Pigment Yellow 12, C.I. Pigment Yellow 13, C.I. Pigment Yellow 14, C.I. Pigment yellow 15, C.I. Pigment Yellow 17, C.I. Pigment Yellow 93, C.I. Pigment Yellow 94, C.I. Pigment Yellow 138, C.I. Pigment Yellow 155, C.I. Pigment Yellow 156, C.I. Pigment yellow 180, C.I. Pigment Yellow 185, Pigment Yellow 155, Pigment Yellow 186, and the like.

Listed as pigments for green or cyan are C.I. Pigment Blue 15, C.I. Pigment Blue 15:2, C.I. Pigment Blue 15:3, C.I. Pigment Blue 16, C.I. Pigment Blue 60, C.I. Pigment Green 7, and the like.

Employed as dyes may be C.I. Solvent Red 1, 59, 52, 58, 63, 111, 122; C.I. Solvent Yellow 19, 44, 77, 79, 81, 82, 93, 98, 103, 104, 112, 162; C.I. Solvent Blue 25, 36, 60, 70, 93, and 95; and the like. Further these may be employed in combination.

If desired, these organic pigments, as well as dyes, may be employed individually or in combination of selected ones. Further, the added amount of pigments is commonly between 2 and 20 percent by weight, and is preferably between 3 and 15 percent by weight.

The colorants may also be employed while subjected to surface modification. Examples of the surface modifying agents include silane coupling agents, titanium coupling agents, aluminum coupling agents, and the like.

Examples of the silane coupling agent include alkoxysilane such as methyltrimethoxysilane, phenyltrimethoxysilane, methylphenyldimethoxysilane and diphenyldimethoxysilane; siloxane such as hexamethyldisiloxane, γ-chloropropyltrimethoxysilane, vinyltrichlorosilane, vinyltrimethoxysilane, vinyltriethoxysilane, γ-methacryloxypropyltrimethoxysilane, γ-glycidoxypropyltrimethoxysilane, γ-mercaptopropyltrimethoxysilane, γ-aminopropyltriethoxysilane, and γ-ureidopropyltriethoxysilane.

Examples of the titanium coupling agent include those marketed with brand "Plainact" TTS, 9S, 38S, 41B, 46B, 55, 138S, 238S etc., by Ajinomoto Corporation, A-1, B-1, TOT, TST, TAA, TAT, TLA, TOG, TBSTA, A-10, TBT, B-2, B-4, B-7, B-10, TBSTA-400, TTS, TOA-30, TSDMA, TTAB, TTOP etc., marketed by Nihon Soda Co., Ltd.

Examples of the aluminum coupling agent include "Plainact AL-M".

These surface modifiers is added preferably in amount of 0.01 to 20% by weight, and more preferably 0.5 to 5% by weight with reference to the colorant.

Surface of the colorant may be modified in such way that the surface modifier is added to the dispersion of colorant, then the dispersion is heated to conduct reaction.

Colorant having subjected to the surface modification is separated by filtration and dried after repeating rinsing and filtering with the same solvent.

Releasing Agents

Toner employed in the invention is preferably prepared by fusing resin particles containing a releasing agent and colored particles in water based medium and then digesting the obtained particles whereby the releasing agent and the colorant are dispersed in resin matrix adequately to form a domain-matrix structure. The digestion is a process subjecting the fused particles to continuing agitation at a temperature of melting point of the releasing agent plus minus 20 centigrade.

Preferable examples of the releasing agent include low molecular weight polypropylene and low molecular weight polyethylene each having average molecular weight of 1,500 to 9,000, and a particularly preferable example is an ester compounds represented by General Formula (1), described below.

$$R^1—(OCO—R^2)_n \quad (1):$$

wherein n represents an integer of 1 to 4, and preferably 2 to 4, more preferably 3 or 4, and in particular preferably 4, $R^1$ and $R^2$ each represent a hydrocarbon group which may have a substituent respectively. $R^1$ has from 1 to 40 carbon atoms, and preferably 1 to 20, more preferably 2 to 5. $R^2$ has from 1 to 40 carbon atoms, and preferably 16 to 30, more preferably 18 to 26.

The representative examples are listed.

1) $CH_3-(CH_2)_{12}-COO-(CH_2)_{17}-CH_3$

2) $CH_3-(CH_2)_{18}-COO-(CH_2)_{17}-CH_3$

3) $CH_3-(CH_2)_{20}-COO-(CH_2)_{21}-CH_3$

4) $CH_3-(CH_2)_{14}-COO-(CH_2)_{19}-CH_3$

5) $CH_3-(CH_2)_{20}-COO-(CH_2)_6-O-CO-(CH_2)_{20}-CH_3$

6) $CH_3-(CH_2)_{20}-COO-(CH_2)_2-CH(CH_3)-CH_2-O-CO-(CH_2)_{20}-CH_3$

7) $CH_3-(CH_2)_{22}-COO-(CH_2)_2-CH(CH_3)-CH_2-O-CO-(CH_2)_{22}-CH_3$

8) $CH_3-(CH_2)_{22}-COO-CH_2-CH(CH_3)_2-CH_2-O-CO-(CH_2)_{22}-CH_3$

9) $CH_3-(CH_2)_{26}-COO-CH_2-CH(CH_3)_2-CH_2-O-CO-(CH_2)_{26}-CH_3$

10) $CH_2(O-CO-(CH_2)_{26}-CH_3)-CH(O-CO-(CH_2)_{26}-CH_3)-CH_2(O-CO-(CH_2)_{26}-CH_3)$

11) $CH_2(O-CO-(CH_2)_{22}-CH_3)-CH(O-CO-(CH_2)_{22}-CH_3)-CH_2(O-CO-(CH_2)_{22}-CH_3)$

12) $CH_2(OH)-CH(O-CO-(CH_2)_{26}-CH_3)-CH_2(O-CO-(CH_2)_{26}-CH_3)$

13) $CH_2(OH)-CH(O-CO-(CH_2)_{22}-CH_3)-CH_2(O-CO-(CH_2)_{22}-CH_3)$

14) $CH_2(OH)-CH(OH)-CH_2(O-CO-(CH_2)_{26}-CH_3)$

15) $CH_2(OH)-CH(OH)-CH_2(O-CO-(CH_2)_{22}-CH_3)$

-continued

16) $CH_3-(CH_2)_{26}-COO-CH_2-C(CH_3)(CH_2-O-CO-(CH_2)_{26}-CH_3)_2-CH_2-O-CO-(CH_2)_{26}-CH_3$

17) $CH_3-(CH_2)_{20}-COO-CH_2-C(CH_2CH_3)(CH_2-O-CO-(CH_2)_{20}-CH_3)_2-CH_2-O-CO-(CH_2)_{20}-CH_3$

18) $CH_3-(CH_2)_{26}-COO-CH_2-C(CH_2-O-CO-(CH_2)_{26}-CH_3)_3-CH_2-O-CO-(CH_2)_{26}-CH_3$

19) $CH_3-(CH_2)_{20}-COO-CH_2-C(CH_2-O-CO-(CH_2)_{20}-CH_3)_3-CH_2-O-CO-(CH_2)_{20}-CH_3$

20) $CH_3-(CH_2)_{18}-COO-CH_2-C(CH_2-O-CO-(CH_2)_{18}-CH_3)_3-CH_2-O-CO-(CH_2)_{18}-CH_3$

21) $CH_3-(CH_2)_{16}-COO-CH_2-C(CH_2-O-CO-(CH_2)_{16}-CH_3)_3-CH_2-O-CO-(CH_2)_{16}-CH_3$

22) $CH_3-(CH_2)_{20}-COO-CH_2-C(CH_2-O-CO-CH_3)_3-CH_2-O-CO-CH_3$

The releasing agent is added in an amount of between 2 and 20 percent by weight, and is preferably between 3 and 15 percent by weight.

The releasing agent is preferably incorporated in the toner particles by salting-out/fusing a colorant and resin particles involving the releasing agent prepared by mini-emulsion method.

Addition Process of External Additives

External additives are added to the dried toner particles. Examples of the additive include metal salt of aliphatic acid, external abrasive, usual additives such as silica fine powder. Examples of the preparation apparatus include Henschel mixer, Nauter mixer.

Developer and Developing Method

The toner of the present invention may be employed in either a single-component developer or a two-component developer.

Listed as single-component developers are a non-magnetic single-component developer, and a magnetic single-component developer in which magnetic particles having a diameter of 0.1 to 0.5 μm are incorporated into a toner. The toner may be employed in both developers.

Further, said toner is blended with a carrier and employed as a two-component developer. In this case, employed as magnetic particles of the carrier may be conventional materials known in the art, such as metals such as iron, ferrite, magnetite, and the like, alloys of said metals with aluminum, lead and the like. Specifically, ferrite particles are preferred. The volume average particle diameter of said magnetic particles is preferably 15 to 100 μm, and is more preferably 25 to 80 μm.

The volume average particle diameter of said carrier can be generally determined employing a laser diffraction type particle diameter distribution measurement apparatus "Helos", produced by Sympatec Co., which is provided with a wet type homogenizer.

The preferred carrier is one in which magnetic particles are further coated with resins, or a so-called resin dispersion type carrier in which magnetic particles are dispersed into resins. Resin compositions for coating are not particularly limited. For example, employed are olefin based resins, styrene based resins, styrene-acryl based resins, silicone based resins, ester based resins, or fluorine containing polymer based resins. Further, resins, which constitute said resin dispersion type carrier, are not particularly limited, and resins known in the art may be employed. For example, listed may be styrene-acryl based resins polyester resins, fluorine based resins, phenol resins, and the like.

Employed as development methods may be either a contact method or a non-contact method. When the non-contact development method is employed, it is possible to carry out normal development under non-contact as well as reversal development under non-contact. In such a case, a direct current development electric field is commonly from $1\times10^3$ to $1\times10^5$ V/cm in terms of the absolute value, and is preferably from $5\times10^3$ to $1\times10^4$ V/cm.

An image forming apparatus, employing the photoreceptor drum of the present invention, will now be described.

(4) Charging Processes and Charging Members

Employed as charging processes of the present invention may be a magnetic brush system, a charging roller system, and a blade system, in which it is possible to use various types of charging members. Of these, in the present invention, most preferably employed as a charging member is either a charging roller system or a magnetic brush system. Namely, the charging roller or the magnetic brush is preferred which tends to result in uniform charging. In the following, described are charging processes and charging means, employing the charging roller system or the magnetic brush system.

In the present invention, it is possible to charge a photoreceptor in such a manner that a charging roller or a magnetic brush comprised of a conductive elastic charging member is brought into contact with the photoreceptor and voltage is applied to the charging roller.

1. Charging Roller System (1) Structure and Production Method of Charging Roller Such a charging roller system may include either a direct current charging system in which direct current voltage is applied to a roller or an induced charging system in which alternative current voltage is applied to a roller.

Frequency f of the applied voltage, employing the induced charging system is optional. However, in order to minimize strobing, namely a striped pattern, it is possible select appropriate frequency corresponding to the relative speed between the conductive elastic roller and the photoreceptor. It is possible to determine the aforesaid relative speed depending on the contact area of the conductive elastic roller with the photoreceptor.

The conductive elastic roller is prepared by covering the outer circumference of a metal cylinder with a layer (hereinafter occasionally referred to simply as a conductive elastic layer or a conductive rubber layer) comprised of a conductive elastic member.

Listed as rubber compositions usable in the aforesaid conductive rubber layer are polynorbonane rubber, ethylene-propylene rubber, chloroprene rubber, acrylonitrile rubber, and silicone rubber. These types of rubber may be employed individually or in combination of at least two types.

In order to provide electrical conductivity, electrical conductivity providing agents are incorporated in these rubber compositions, and the resulting compositions are employed. Listed as suitable electrical conductivity providing agents are carbon blacks known in the art (such as furnace based carbon blacks or kechen black), metal powders such as tin oxides. The used amount of electrical conductivity providing agents is from 5 to 50 parts by weight with respect to all rubber compositions.

Other than rubber base materials, foaming agents, and electrical conductivity providing agents, as well as, if desired, compounds for rubber and rubber additives may be added, whereby an conductive foam rubber composition may be prepared. Employed as compounds for rubber and rubber additives may be vulcanizing agents such as sulfur and peroxides, vulcanization accelerators such as zinc white and stearic acid, vulcanization accelerators such as sulfeneamide series, tyraum series, thiazole series, and guanidine series, age resisters such as amine series, phenol series, and phosphorous series, antioxidants, UV absorbers, antiozonants, and tackifiers. Further, it is possible to optionally select and employ various types of reinforcers, friction coefficient regulating agents, and inorganic fillers such as silica, talc, clay. It is preferable that these conductive rubber layers exhibit a direct current volume resistivity in the range of $10^3$ to $10^7$ Ω·cm.

For the purpose of minimizing adhesion of residual toner on the photoreceptor surface onto the charging member, a releasable cover layer may be provided on the exterior surface of these conductive elastic layers. Various functions are achieved which include the minimization of oil oozed from the aforesaid cover layer or the elastic layer, the minimization of non-uniform resistance of the elastic layer so as to achieve uniform resistance, the protection of the charging roller surface, and the adjustment of the hardness of the charging roller. Any cover layer may be employed, as long as the aforesaid physical properties are satisfied, and may be comprised of a single layer or a plurality of layers. Listed as materials are resins such as hydrin rubber, urethane rubber, nylon, polyfluorinated vinylidene, and polyvinylidene chloride.

The thickness of the cover layer is preferably from 100 to 1,000 μm, while the resistance value is preferably from $10^5$ to $10^9$ Ω·cm. Further, it is preferable that as approaching the surface, the resistance value increases. Listed as methods to regulate the resistance is incorporation of conductive materials such as carbon black, metals, and metal oxides in the cover layer.

In order to regulate surface roughness Rz of the charging roller, it is preferable that powders are incorporated in the surface layer (a conductive elastic layer or a cover layer) of the charging roller. Powders employed in the present invention may be either inorganic materials or organic materials. In the case of inorganic materials, silica powder is preferred. In the case of organic materials, listed are, for example, urethane resin particles, nylon particles, silicone rubber particles, and epoxy resin particles. These particles may be used individually or in combination of at least two types. As particle compositions, it is preferable to select materials capable of adjusting surface roughness Rz of the surface layer to the range of 0.05 to 10.0 μm. When the particle diameter of the particle body is in the range of 1 to 20 μm, it is easy to achieve the desired surface roughness.

It is preferable that powder is mixed in the surface layer so as to achieve the mixing ratio of 5 to 20 parts by weight with respect to 100 parts by weight of the resins, and the resulting mixture is dispersed.

The charging roller may be prepared, for example, as follows. Namely, initially, a metal rotation shaft (a metal rod) is placed in a molding form having a cylindrically shaped molding space and the interior of the molding form is filled with conductive elastic layer forming materials. By carrying out vulcanization, a conductive elastic body layer is formed on the circumferential surface of the rotation shaft. Subsequently, the rotation shaft, which has been subjected to formation of the conductive elastic body layer, is removed from the molding form. On the other hand, materials such as urethane resins, particles, electrical conductivity providing agents, and other additives are blended, and the resulting blend is mixed and stirred employing a ball mill and the like, whereby a surface layer forming material blend is prepared. Subsequently, the resulting blend is applied onto the surface of the rotation shaft which has been subjected to formation of the aforesaid conductive elastic body layer, so as to achieve uniform thickness, employing a dip coating method, a roll coating method, or a spray coating method, subsequently dried, and thermally cured, whereby it is possible to produce a two-layer structured charging roller.

The charging roller, prepared as above, results in formation of the surface layer, as the outermost layer, having surface roughness Rz of 0.05 to 10.00 μm.

(2) Application Example of Charging Roller to Image Forming Apparatus

FIG. 12 is a view showing one example of a structure of an image forming apparatus to which a charging roller is applied. This image forming apparatus is employed to achieve the present invention. The embodiment is that in order to form electrostatic latent images, a photoreceptor drum is charged while brought into contact with a charging roller; further, for transferring toner onto a transfer paper sheet, a transfer roller is employed at the transfer electrode, and the aforesaid transfer roller is, directly or via transfer paper, brought into contact with the photoreceptor drum so that ozone generation is avoided.

In FIG. 12(*a*), an electrostatic latent image is formed on photoreceptor drum 3 which has been charged employing charging roller 4. Subsequently, the resulting electrostatic latent image is visualized into a toner image, by employing a development sleeve which is a developer holding body of development unit 16 arranged adjacent to photoreceptor drum 3. Subsequently, charge on photoreceptor drum 3 is eliminated by charge eliminating lamp 5 prior to transfer. On the other hand, transfer material 18 (transfer paper sheet) which has been conveyed from the paper feeding cassette, employing transfer roller 8, is provided with charge having polarity opposite to toner and the resulting toner image is transferred onto transfer material 18, utilizing electrostatic force of charge having the aforesaid opposite polarity. After transferring toner, transfer material 18 is separated from photoreceptor drum 3, and then transported to a fixing apparatus, employing transport belt 7. Subsequently, the toner image is fixed onto transfer material 18, employing a heating roller and a pressure roller.

Aforesaid charging roller 4 (and transfer roller 6) is subjected to application of bias voltage comprised of DC and AC components from power source 9 or 10, and under a state in which ozone generation is minimized, photoreceptor drum 3 is charged, while toner images are transferred onto transfer paper 18. The aforesaid bias voltage is comprised of DC bias of commonly ±500 to ±1,000 V, and AC bias of 100 Hz to 10 KHz, 200 to 3500 Vp-p which is superposed to the aforesaid DC bias.

Aforesaid charging roller 4 and transfer roller 6 are subjected to driven or enforced rotation while brought into pressure contact with photoreceptor drum 3.

The aforesaid pressure contact with photoreceptor drum 3 is performed so as to result in a pressure of 0.1 to 1.0 N/cm, and the roller rotation rate is 1 to 8 times peripheral rate of photoreceptor drum 3.

As shown in FIG. 12(*b*), aforesaid charging roller 4 (and transfer roller 6) is comprised of metal rod 20 and a rubber layer comprised of chloroprene rubber, urethane rubber, or silicone rubber which is a conductive elastic member provided on the outer circumference of metal rod 20 or sponge layer 21 thereof and is preferably structured by providing as the outermost layer protective layer 22 comprised of releasable fluorine based resins or a silicone layer, having a thickness of 0.01 to 1.00 μm.

Photoreceptor drum 3 which has completed image transfer is cleaned while brought into pressure contacted with cleaning blade 12 of cleaning unit 11 and is prepared for the subsequent image formation.

Any of the charging roller, the development unit, the transfer roller, and the cleaning unit, which are the components of the electrophotographic image forming apparatus, may be integrated with the photoreceptor so as to form a processing cartridge, and the resulting integrated unit may be removably attached to the aforesaid apparatus. Further, at least one of the image exposure unit, the development unit, the transfer or separation unit, and the cleaning unit is integrated with a photoreceptor so as to form a processing cartridge which is removably attached (possible to get in and out) to the aforesaid apparatus as a single unit, and the resulting unit may be installed, employing a guide means such as a rail in the aforesaid apparatus.

In aforesaid FIG. 12, the roller charging unit is employed as a charging unit and a transfer electrode. However, in the present invention, invention is that the charging roller is employed as a charging unit. Therefore, transfer means other than the transfer roller may be utilized as a transfer electrode.

2. Magnetic Brush System (1) Structure of Magnetic Brush Charging Unit

Magnetic particles which form a charging magnetic brush will now be described.

Figure 13:
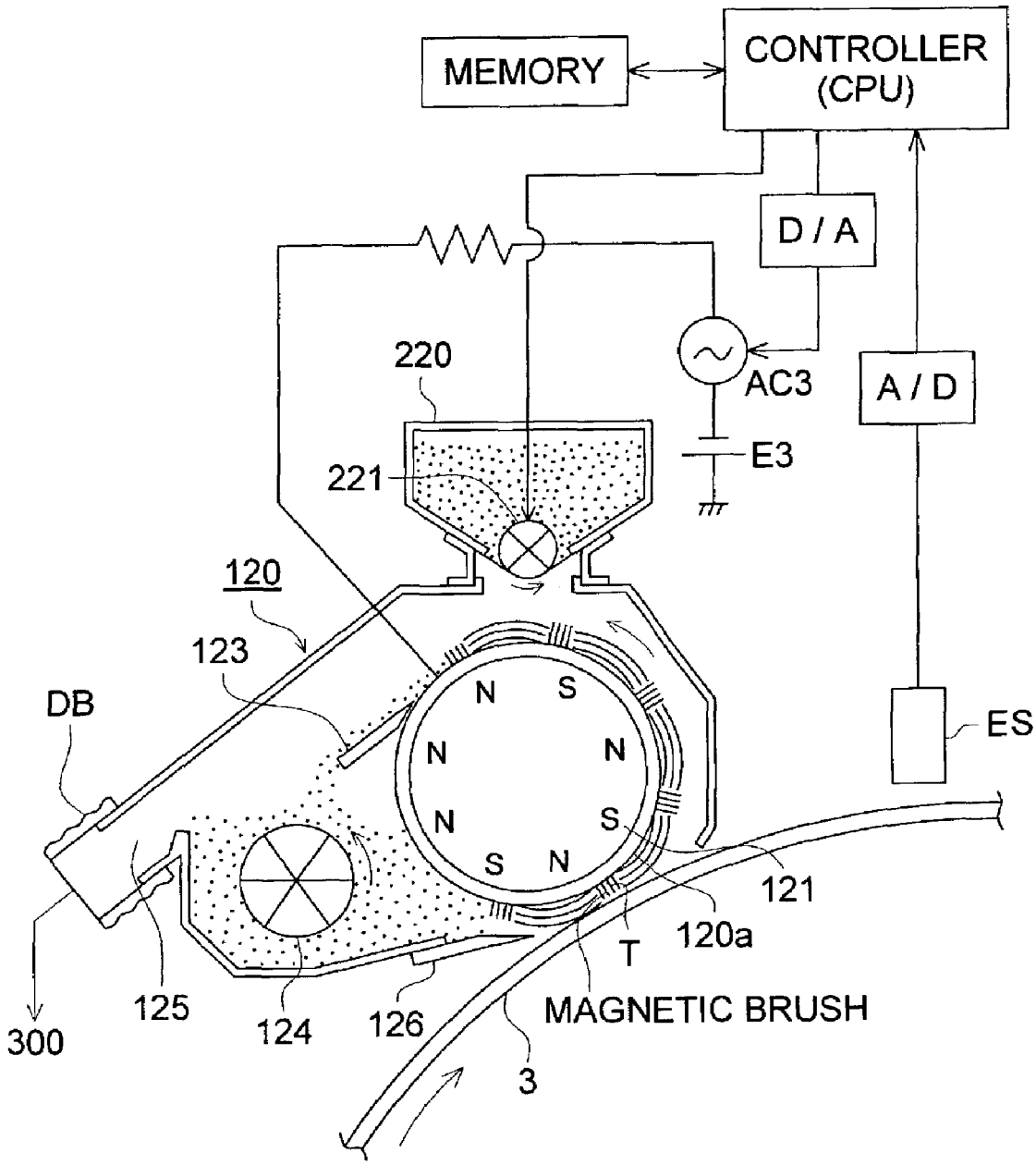
FIG. 13 is a view showing a structure of a magnetic brush charging unit.
Figure 14:
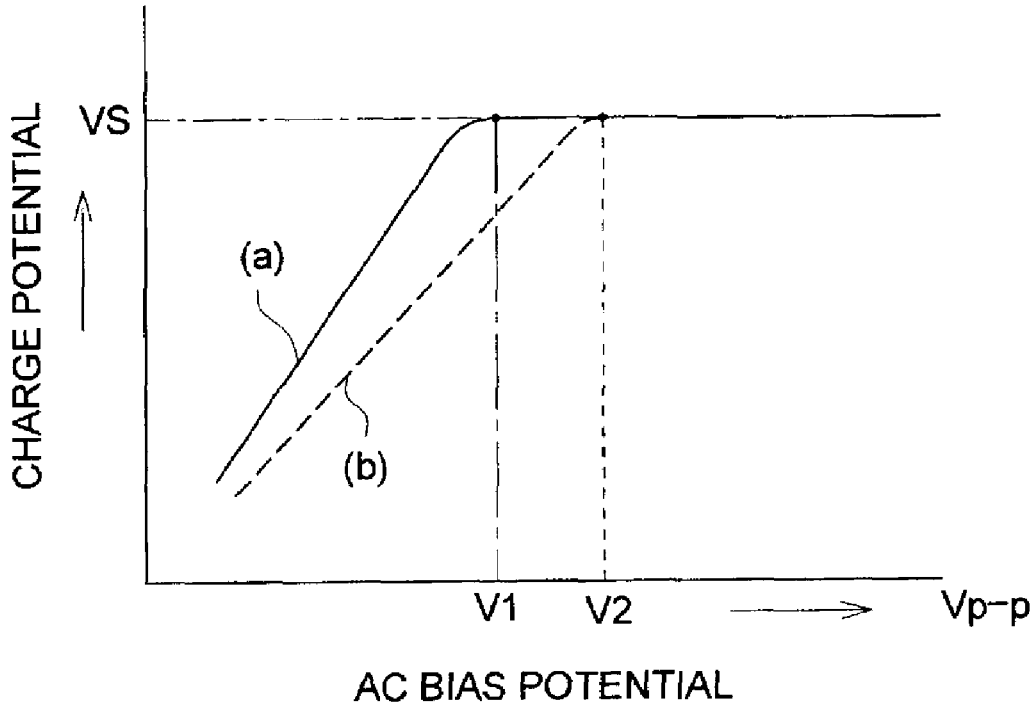
FIG. 14 is a view showing the relationship between the alternative current bias voltage by a charging unit and the charging potential.

FIG. 13 is a view showing the structure of a contact type magnetic brush charging unit, while FIG. 14 is a view showing the relationship between the alternative current bias voltage formed by the charging unit in FIG. 14 and the charging potential.

Generally speaking, when the volume average diameter of magnetic particles which form the charging magnetic brush increases, the phenomenon described below occur. Since the tip state of the magnetic brush, formed on a charging magnetic particle transport body (a transport carrier) becomes rough, unevenness tends to result in the magnetic brush, even though charging is performed under vibration formed by an eclectic field, whereby problems with uneven charging occur. These problems are overcome by decreasing the volume average particle diameter. Experimental results show that when the volume average particle diameter reaches less than or equal to 200 μm, the resulting effects are exhibited. Specifically, when the aforesaid diameter reaches less than or equal to 150 μm, problems with the rough tip of the magnetic brush are substantially overcome. However, when the aforesaid particle diameter excessively decreases, the resulting particles tend to adhere to the surface of photoreceptor drum 3 or to be scattered. These phenomena relate to the strength of the magnetic field which act on particles and the intensity of particle magnetization thereby. Generally, the aforesaid phenomenon are pronounced when the average volume diameter of particles is less than or equal to 20 μm.

As noticed above, it is preferable that the average volume diameter of magnetic particles is from 20 to 200 μm and the proportion of magnetic particles having a particle diameter of less than or equal to ½ time number average diameter of the aforesaid magnetic particles is less than or equal to 30 percent by number. Incidentally, preferably employed intensity of magnetization is from $3.7\times10^{-2}$ to $13\times10^{-2}$ ewb·m/g.

Such magnetic particles are prepared as follows. In the same manner as magnetic carrier particles of the conventional double component developer, employed as magnetic materials are metals such as iron, chromium, nickel and cobalt or compounds or alloy thereof such as tetratriiron oxide, γ-ferric oxide, chromium dioxide, manganese oxide, ferrite, and manganese-copper based alloy. By employing these, ferromagnetic particles are prepared. The surface of these particles may be covered with resins such as styrene based resins, vinyl based resins, ethylene based resins, rosin modified resins, acryl based resins, polyamide resins, epoxy resins, or polyester resins. Alternatively, particle may be prepared employing resins into which minute magnetic particles are dispersed. Subsequently, the resulting particles are subjected to particle diameter classification, employing conventional average particle diameter classification means, known in the art.

Incidentally, when magnetic particles are spherically shaped, a particle layer formed on the transport carrier becomes uniform. Further, it is possible to effectively and uniformly apply high bias voltage to the transport carrier. Namely, formation of spherical magnetic particles exhibits the following effects.

(1) Generally, magnetic particles tend to be subjected to magnetization and adsorption in the long axial direction. However, when shaped to be spherical, magnetic particles exhibit no directional properties. As a result, the resulting magnetic particle layer is uniformly formed, whereby formation of localized regions having a low resistance and uneven layer thickness is minimized.

(2) As the resistance of magnetic particles increases, edges found in conventional particles are not formed. As a result, the resulting electric field is not intensified in the edges, whereby effects are exhibited in which even though high bias voltage is applied to the transport carrier of charging magnetic particles, uneven charging does not occur while uniformly discharged onto the surface of photoreceptor drum 3.

As spherical particles which exhibit effects described above, it is preferable that conductive magnetic particles are formed so as to have a resistivity of $10^5$ to $10^{10}$ Ω·cm. The aforesaid resistively is obtained as follows. Particles are placed in a container having a cross-sectional area of 0.50 $cm^2$ and then tapped. Thereafter, a load of 9.8 $N/cm^2$ is applied onto filled particles. The aforesaid resistivity is then obtained by recording the eclectic current value when voltage is applied between the load and the bottom surface electrode so as to form an electric field of 100 V/cm between the load and the bottom surface electrode. When the aforesaid resistivity decreases, electric charge is injected into magnetic particles during application of bias voltage to the transport carrier. As a result, magnetic particles tend to adhere to the surface of photoreceptor drum 3, or breakage of photoreceptor drum 3 tends to occur due to the bias voltage. Further, when the resistivity increases, charging is not carried out due to minimal injection of electric charge.

Preferable magnetic particles employed in contact type magnetic brush charging unit 120 is as follows. The magnetic brush, comprised of the magnetic particles, lightly moves in accordance with a vibrating magnetic field; the specific gravity is low so that no scattering to the exterior occurs, and suitable maximum magnetization is exhibited. Specifically, it was discovered that desired results were obtained by employing magnetic particles having a true specific gravity of at most 6 and a maximum magnetization of $3.7\times10^{-2}$ to $13\times10^{-2}$ ewb·m/g and particularly $5.0\times10^{-2}$ to $80\times10^{-2}$ ewb·m/g.

Taking the foregoing into consideration, it is preferable that magnetic particles are spherically shaped so that the ratio of the long axis to the short axis is at most three times; projections such as needle shaped portions or edge portions are not formed; and the resistivity is preferably in the range of $10^5$ to $10^{10}$ Ω·cm. Such spherically shaped magnetic particles are produced as follows. Magnetic particles which are as spherical as possible should be selected. In particles of minute magnetic material particle dispersion system, minute magnetic material particles are employed as many as possible, and after forming dispersion resinous particles, a sphere shaping treatment is carried out. Alternatively, dispersion resinous particles are formed employing a spray dry method.

FIGS. 13 and 14 will now be described. Magnetic brush charging unit 120 faces rotating photoreceptor drum 3. Photoreceptor drum 3 and its adjacent section (charging section T), comprise cylindrical charging sleeve 120*a* comprised of, for example, aluminum and stainless steal, as a charging magnetic particle transport body, which rotates in the same direction (the counterclockwise direction); magnet body 121 comprised of an N pole and an S pole provided in the interior of aforesaid charging sleeve 120*a*; a magnetic brush, comprised of magnetic particles, which is formed on the outer circumferential surface of charging sleeve 120*a*, employing aforesaid magnet body 121, and charges photoreceptor drum 3; scraper 123 which scrapes the magnetic brush on aforesaid charging sleeve 120*a* in the N-N magnetic pole section of magnet body 121; stirring screw 124 which stirs magnetic particles in magnetic brush charging unit 120 or ejects used magnetic particles from ejection exit 125 of magnetic brush charging unit 120 while resulting in overflow during supply of magnetic particles; and magnetic brush tip regulating plate 126. Charging sleeve 120*a* is rotatably provided with respect to magnet body 121 and is preferably rotated at a peripheral rate of 0.1 to 1.0 times in the same direction (the counterclockwise direction) as the moving direction of photoreceptor drum 3 at the position facing photoreceptor drum 3. Further, employed as charging sleeve 120*a* is a conductive transport carrier capable of applying charging bias voltage. Specifically, charging sleeve 120*a*, which is structured as described below, is preferably employed. Magnet body 121, having a plurality of magnetic poles, is provided in the interior of conductive charging sleeve 120*a* in which a particle layer is formed on the surface. In such a transport carrier, the magnetic particle layer, formed on the surface of conductive charging sleeve 120*a* due to relative rotation with respect to magnet body 121, moves while forming wavy ups and downs. As a result, fresh magnetic particles are successively supplied. Even though the magnetic particle layer on the surface of charging sleeve 120*a* results in somewhat non-uniformity of the layer thickness, the resulting adverse effects are minimized by the aforesaid wavy ups and downs so as not to result in practical problems. In order to achieve stable and uniform transport of magnetic particles, it is preferable that the surface of charging sleeve 120*a* results in a surface average roughness of 5.0 to 30.0 μm. When the surface is smooth, it is impossible to carry out desired transport. On the other hand, when the surface is excessively rough, excess current tends to run from projections on the surface. As a result, in either case, uneven charging tends to occur. In order to achieve the aforesaid roughness, a sand blast treatment is preferably employed. Further, the outer diameter of charging sleeve 120*a* is preferably from 5.0 to 20.0 mm. By so doing, a contact region, which is necessary for charging, is assured. When the contact region is larger than required, charging current becomes excessive, while when it is smaller, uneven charging tends to occur. Further, when the diameter is decreased as described above, magnetic particles tend to be scattered due to centrifugal force or to adhere to photoreceptor drum 3. Therefore, it is preferable that the linear rate of charging sleeve 120*a* is nearly the same as the moving rate of photoreceptor drum 3 or less than that.

Further, the magnetic particle layer formed on charging sleeve 120*a* preferably has thickness so as to result in a uniform layer after being sufficiently scraped by the regulating means. When the amount of magnetic particles on the surface of charging sleeve 120*a* in the charging region is excessively large, magnetic particles are not subjected to sufficient vibration. As a result, problems occur in which the photoreceptor results in weir and abrasion as well as uneven charging, and excessive current tends to run, resulting in an increase in the driving torque of charging sleeve 12*a*. On the other hand, when the amount of magnetic particles on charging sleeve 120*a* in the charging region is excessively small, contact with photoreceptor drum 3 is not partially achieved, resulting in adhesion of magnetic particles onto photoreceptor drum 3 and uneven charging.

Photoreceptor drum 3 is charged as follows. In magnetic brush charging unit 120 as a charging unit, charging bias in which, if desired, direct current (DC) bias E3 is subjected to superimposition of alternative current (AC) bias AC3, for example, −100 to −500 V having the same polarity (in the present embodiment, minus polarity) as direct current bias E3, and charging bias having a frequency of 1 to 5 kHz and a voltage of 300 to 500 Vp-p as alternative current AS3 is applied to charging sleeve 120*a*. The circumferential surface of photoreceptor drum 3 comes into contact with and rubbed by the resulting charging sleeve 120*a* so as to be charged. A vibration electric field is formed between charging sleeve 120*a* and photoreceptor drum 3 through application of voltage of aforesaid alternative current bias AC3. As a result, charge is smoothly injected onto the photoreceptor drum through the magnetic brush, resulting in uniform and high speed charging.

The magnetic brush above charging sleeve 120*a*, which has charged photoreceptor drum 3 is dropped on aforesaid charging sleeve 120*a* in the N-N magnetic pole section provided in magnet body 121, employing scraper 123, and is stirred by screw 124 which rotates in the reverse direction (the counterclockwise direction) to charging sleeve 120*a* in the section adjacent to charging sleeve 120*a*. Thereafter, the magnetic brush is again formed and transported to charging section T.

As shown in FIG. 14, the relationship between the peak-peak voltage Vp-p of alternative current bias AC3 of charging bias and the charging potential is as follows. As the peak-peak voltage Vp-p increases, the resulting charging potential increases and the charging potential is saturated at the value which nearly equals to VS which is the value of direct current bias E3 of charging bias at V1 at which the peak-peak voltage is constant. Even though peak-peak voltage Vp-p increases more than that, it is characterized that the charging potential results in almost no variation. The electric resistance of magnetic particles varies depending on ambient conditions. Further, during the use, the electric resistance increases due to fusion of toner on the surface of magnetic particles. Due to that, in the case of fresh magnetic particles during initial use, the resulting characteristic curve locates on the left side, shown as (a) in solid line, while in the case of magnetic particles which have been used over an extended period of time, the resulting characteristic cure locates on the right side, shown as (b) in dotted line.

In the contact system charging unit of the image forming apparatus of the present invention, when the power source of the apparatus is turned on or before printing is initiated, the voltage value of direct current bias E3, corresponding to the charging potential, is designated as a specified value. Subsequently, charging bias is applied while increasing peak-peak voltage Vp-p from a lower value and the charging potential which varies during the operation is detected employing electrometer ES. The detected charging potential is converted to digital values, employing an A/D converter, and subsequently inputted to a control section (CPU). In the control section, when the aforesaid charging potential reaches the saturation point of specified VS value, printing is operated while specifying Vp-p value as optimal bias value V1.

Namely, during printing, alternative current bias AC3 is subjected to a gradual increase (or sweeping) from a lower value, and Vp-p value V1 of alternative current bias AC3 is obtained. Subsequently bias signals are outputted from the control section. The resulting control signals are converted to analogue values, employing a D/A converter, and subsequently the resulting analogue values are transmitted to alternative bias AC3. Alternative current bias AC3 then outputs determined peak-peak voltage V1. At that time, the peak-peak voltage V1 value and specified value V2, stored in memory, which requires replacement of degraded magnetic particles are read and both are compared. Since the resistance of magnetic particles increases due to mixing of toner, optimal bias value V1 increases as printing is continuously carried out. Due to that, applied Vp-p increases and a state occurs in which it is impossible to carry out charging. When the measured voltage value is less than specified value V2 which indicates that it is impossible to carry out charging, image formation is continuously carried out. However, when the measured voltage exceeds specified value V2, image forming operation terminating signals are transmitted from the control section, whereby image forming operation is terminated. In the display section of an operation section (not shown), abnormality of the charging unit is displayed. Based on the resulting display, supply bottle 220 of charging magnetic particles is placed in magnetic brush charging unit 120 and a close-open lid (not shown) of the bottom surface of supply bottle 220 is opened and the magnetic particles are allowed to fall down to magnetic brush charging unit 120 and supplied. In the foregoing, the potential of photoreceptor drum 3 is measured employing electrometer ES. However, alternative current bias Vp-p is varied by connecting a direct current ampere meter to the bias power source. When the current value reaches saturation, the resulting Vp-p is designated as optimal bias value V1 and magnetic particles may be supplied when exceeding V1 while comparing to specified value V2.

Further, during maintenance or at a definite time such as 500,000-sheet running, charging magnetic particles are replaced. Replacement signals are outputted via the control section at every maintenance print stored in memory or periodically, for example, at every 500,000th print, and supply roller 221 of supply bottle 220 of charging magnetic particles, previously charged, is rotated employing drive of a driving motor (not shown) and all the magnetic particles in supply bottle 220 are allowed to fall into charging unit 120 employing one time operation. It is possible to control the image forming apparatus so as to result in an operation state in such a manner that after supplying magnetic particles, vacant supply bottle 220 is removed and new supply bottle 220 is placed. Further, supply signals such as lamp blinking, which are transmitted from the control section, is periodically displayed in the display section (not shown) and supply bottle 220 is placed in magnetic brush charging unit 120 and magnetic particles may be supplied by opening the open-close lid (not shown) on the bottom surface of supply bottle 220.

The fallen magnetic particles are transported by rotated charging sleeve 120*a*, scraped down from the surface of charging sleeve 120*a* by scraper 123, and supplied to the bottom of magnetic brush charging unit 120. Along with this, used magnetic particles, stored in the interior of magnetic brush charging unit 120, overflow from ejection exit 125, employing stirring screw 124 rotated in the counter-clockwise direction and recovered in common magnetic particle recovery container 300 through duct DB. In such a case, the single supply amount of magnetic particles, which are supplied to the interior of magnetic brush charging unit 120 from supply bottle 220, is preferably from 20 to 50 percent by weight with respect to the total magnetic particles placed in the interior of magnetic brush charging unit 120. When the supply amount is less than 20 percent by weight, the amount of fresh magnetic particles is excessively small and the desired charging is not carried out due to lack of replacement effects, while when the amount exceeds 50 percent by weight, fresh magnetic particles overflow.

By so doing, magnetic particles in the charging unit are not degraded and desired charging properties are maintained.

(2) Use of Magnetic Brush Charging Unit in Image Forming Apparatus

Figure 15:
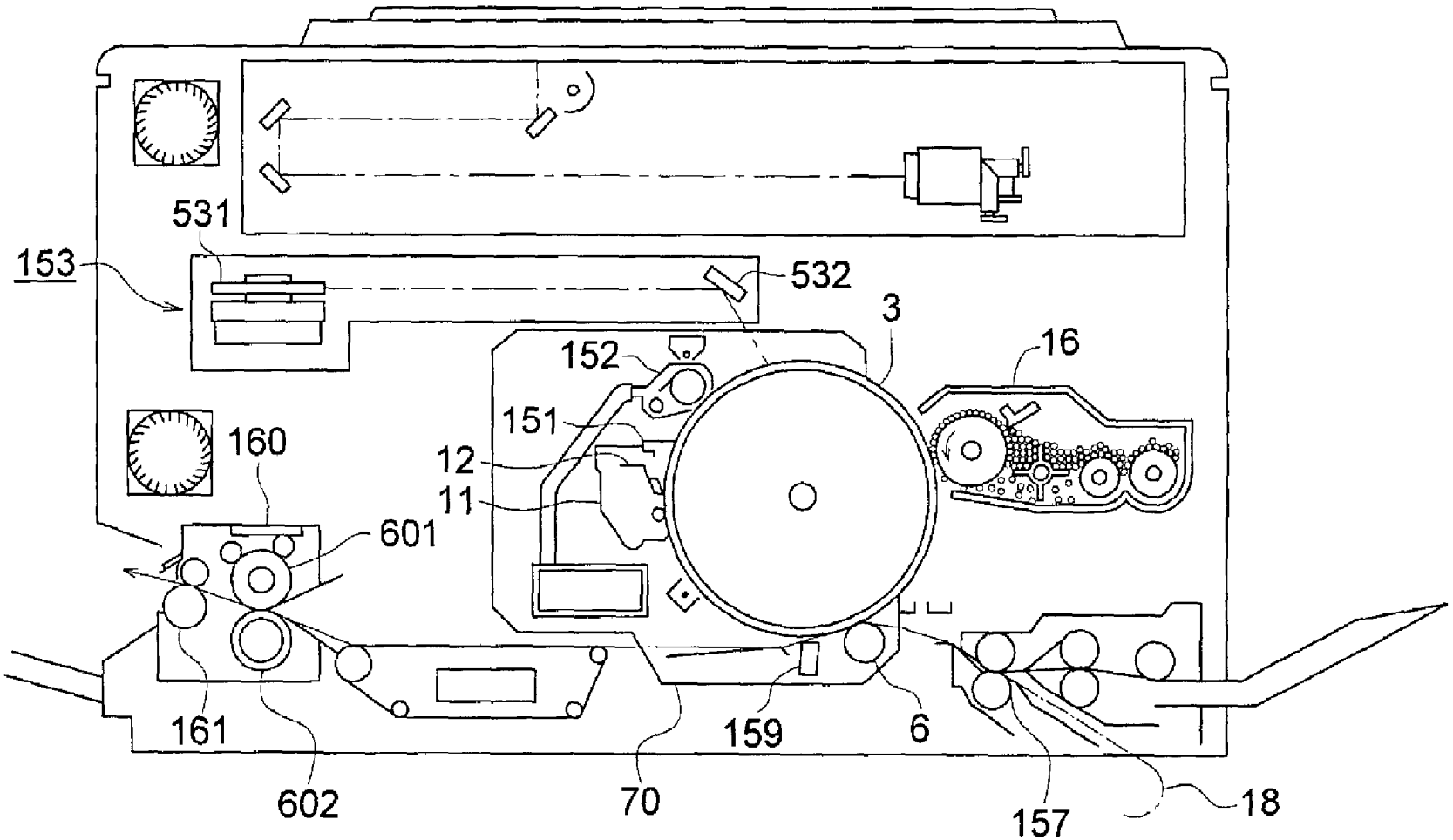
FIG. 15 is a cross-sectional view of one example of an image forming apparatus comprising a magnetic brush charging unit.

FIG. 15 is a cross-sectional view of an image forming apparatus comprising the magnetic brush charging unit of the present invention. In FIG. 15, numeral 3 is a photoreceptor drum (a photoreceptor) which works as an image holding body. The aforesaid photoreceptor is prepared by applying an organic photosensitive layer to a cylindrical substrate and further applying the resinous layer of the present invention thereon. The photoreceptor is grounded and is subjected to driven rotation in the clockwise direction. Numeral 152 is magnetic brush charging unit which results in uniform charging on the circumferential surface of photoreceptor drum 3. Prior to charging employing aforesaid charging unit 152, in order to eliminate the hysteresis of the photoreceptor due to the previous image formation, the circumferential surface of the photoreceptor may be subjected to charge elimination through exposure using exposure section 151 comprising light-emitting diodes and the like.

After uniformly charging the photoreceptor, based on image signals, image exposure is carried out employing image exposure unit 153. In image exposure unit shown in FIG. 15, laser diodes (not shown) are employed as an exposure light source. The photoreceptor is scanned employing light which has been deflected by reflection mirror 532 after passing through rotating polygonal mirror 531 and an fθ lens, whereby electrostatic latent images are formed.

Subsequently, the resulting electrostatic latent image is developed employing development unit 16. Development unit 16, in which a developer comprised of a toner and a carrier is stored, is provided near the periphery of photoreceptor drum 3. Development is carried out employing a rotating development sleeve with magnets in the interior, which holds the developer. The developer is comprised of a carrier which is prepared by applying insulating resins onto the aforesaid cores such as ferrites and a toner which is prepared by externally adding silica and titanium oxide to colored particles comprised of styrene-acryl based resins as a main material, colorants such as carbon black, charge control agents, and low molecular weight polyolefin. The developer layer, having a thickness of 100 to 600 μm, which is formed on the development sleeve while regulated by a layer forming means (not shown), is transported to a development zone, in which development is carried out. At that time, commonly, direct current bias and if desired, alternative current bias voltage are applied between photoreceptor drum 3 and the development sleeve, and development is then carried out. Further, development is carried out under a contact state or a non-contact state of the developer with the photoreceptor.

After image formation, transfer material 18 is fed to a transfer zone through rotation of a paper feeding roller 157 when transfer timing is matched.

In the transfer zone, upon matching the transfer timing, transfer roller 6 (a transfer unit) is brought into pressure contact with the circumferential surface of photoreceptor drum 3 and transfer is carried out while interposing fed transfer material 18.

Subsequently, transfer material 18 is subjected to charge elimination employing separation brush 159 (a separation unit) which has been brought into pressure contact at the almost same time as of the transfer roller, is separated from the circumferential surface of photoreceptor drum 3, and transported to fixing apparatus 160. In fixing apparatus 160, transfer material 18 is subjected to toner fusion by heat and pressure applied by heating roller 601 and pressure roller 602, and subsequently is ejected to the exterior of the apparatus via paper ejection roller 161. Incidentally, after passing transfer material 18, aforesaid transfer roller and separation brush 159 withdraw from the circumferential surface of photoreceptor drum 3 so as to form space and are prepared for the subsequent toner image formation.

On the other hand, photoreceptor drum 3, which has been separated from transfer material 18, is subjected to residual toner removal and cleaning through pressure contact with cleaning unit 11 and cleaning blade 12, is subjected to charge elimination by exposure section 151 and charging by charging unit 152, and initiates the subsequent image forming process.

Numeral 70 is a removably attached processing cartridge (which can be got in and out) in which the charging unit, the transfer unit-separation unit, and the cleaning unit are integrated.

The image forming apparatus may be structured as follows. Components such as the aforesaid photoreceptor, development unit, cleaning unit, and the like, may be integrated as a processing cartridge and the resulting unit may be removably attached (can be got in and out) to the apparatus body. Further at least one of the charging unit, the image exposure unit, the development unit, the transfer or separation unit and the cleaning unit may be integrated with the photoreceptor so as to form a processing cartridge and the resulting processing cartridge may be employed as a single unit which is removably attached (can be got in and out) to the apparatus body, employing guide means such as a rail in the apparatus body.

Figure 16:
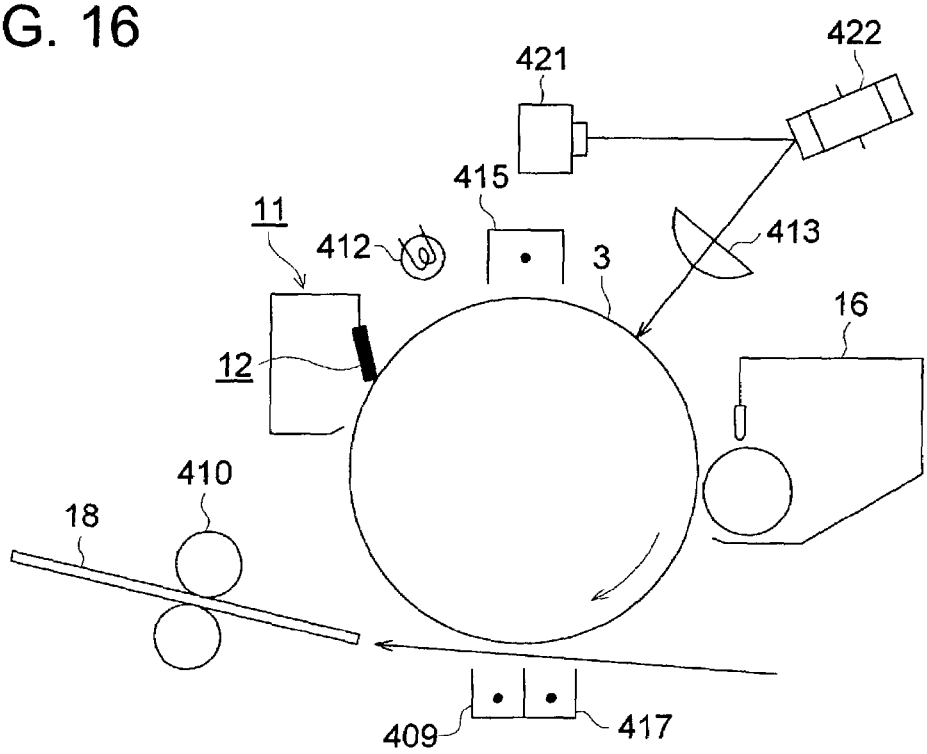
FIG. 16 is a cross-sectional view showing a structure of another example of an image forming apparatus.

FIG. 16 is a cross-sectional view showing the structure of an example of another image forming apparatus employed in the image forming method of the present invention.

In FIG. 16, numeral 3 is the photoreceptor drum which is an image forming body which is prepared by forming organic photoconductors as a photosensitive layer on the circumferential surface of an aluminum drum substrate, and rotates in the arrowed direction at the specified rate.

In FIG. 16, based on information read by an original document reading apparatus (not shown), an exposure beam is emitted from semiconductor laser beam source 421. The resulting beam is allotted to the vertical direction with respect to the sheet surface on which FIG. 16 is drawn, employing polygonal mirror 422 and irradiated on the photoreceptor surface via fθ lens 413 which compensates image distortion, whereby electrostatic latent images are formed. Photoreceptors drum 3 which is an image forming body is previously and uniformly charged employing charging unit 415 and starts rotation in the clockwise direction while matching image exposure timing.

An electrostatic latent image on the photoreceptor surface is developed by development unit 16 and the developed image is transferred onto transfer paper 18, which has been transported while matching timing, utilizing action of transfer unit 417. Further transfer paper 18 is separated from photoreceptor drum 3, employing separation unit 409 (a separation pole), while the toner image is transfer-held on transfer paper 18, transported to fixing unit 410, and fixed.

The non-transferred toner which remains on the photoreceptor surface is removed by cleaning blade 12 of cleaning unit 11 and residual charge is eliminated by pre-charging exposure (PCL) 412. Subsequently, the photoreceptor is again uniformly charged by charging unit 415 for the subsequent image formation.

Toner Recycling System

Systems for recycling toner are not particularly limited. Listed as one of systems may be, for example, a method in which toner recovered in the cleaning section is transported to the hopper for supplying toner or the development unit, employing a transport conveyer or a transport screw, or is supplied to the development unit after being mixed with supply toner in an intermediate chamber. Preferably listed as systems may be a system in which the recovered toner is directly returned to the development unit or supply toner and recovered toner are mixed in the intermediate chamber and the resulting mixture is supplied to the development unit.

Figure 17:
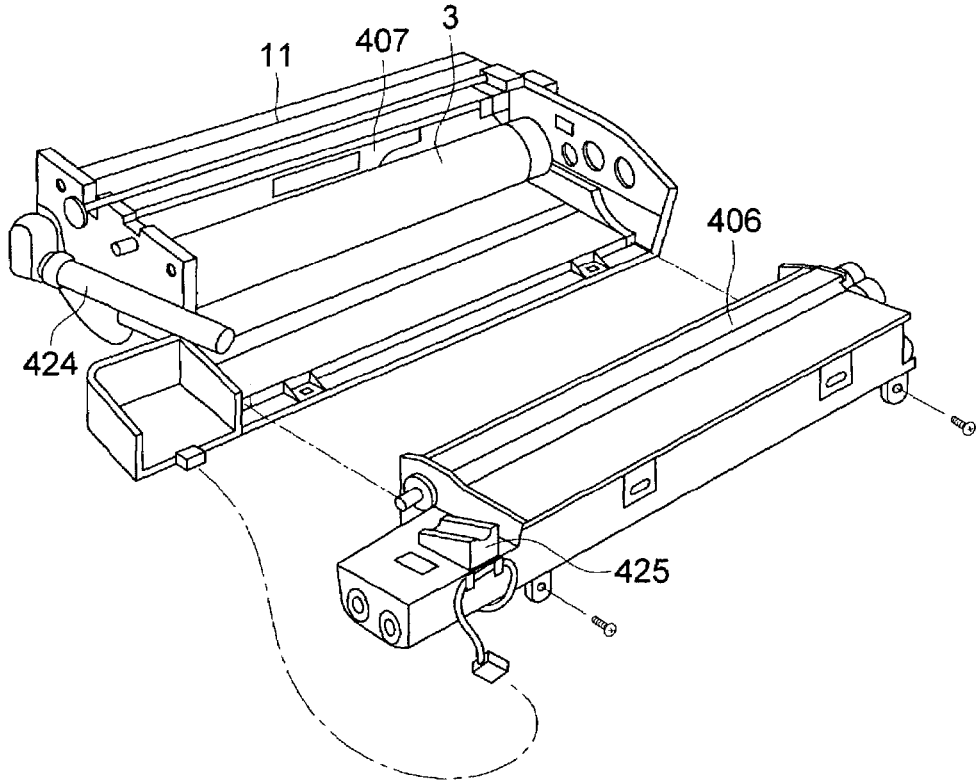
FIG. 17 is a perspective view of a member showing one example of a toner recycling apparatus.

FIG. 17 is a perspective view showing the member structure of one example of a toner recycling apparatus.

In this system, recovered toner is directly returned to the development unit. The non-transferred toner, which is recovered by cleaning blade 12, is collected in toner recycling pipe 24, employing the transport screw in cleaning unit 11, is returned to development unit 16 from exit 425 of the recycling pipe, and is reused as a developer.

FIG. 17 is also a perspective view of a processing cartridge which is removably attached to the image forming apparatus according to the present invention. In FIG. 17, in order to make the perspective view more understandable, the photoreceptor unit and the developer unit are separated. In practice, these are integrated to a single unit which may be removably installed in the image forming apparatus. In this case, the photoreceptor drum, the development unit, the cleaning unit, and the recycling member are integrated so as to constitute a processing cartridge.

The aforesaid image forming apparatus may be structured so that a processing cartridge, which comprises at least one of the charging unit, the development unit, the cleaning unit, or the recycling member together with the photoreceptor drum, is installed.

Representative transfer materials (transfer paper) include plain paper. However, transfer materials are not particularly limited, as long as unfixed images after development are transferable, and include PET bases for overhead projectors or OHP.

As noticed above, employed as cleanings blade 7 is a rubber elastic body having a thickness of about 1 to about 30 mm, and frequently employed as materials is urethane rubber. Since the cleaning blade is employed under pressure contact with the photoreceptor, it is easily affected by heat. Therefore, in the present invention, it is preferable that the cleaning blade is separated from the photoreceptor during no image forming operation while proving a withdrawing mechanism.

It is possible to apply the present invention to image forming apparatuses utilizing an electrophotographic method, particularly to apparatuses in which electrostatic latent images are formed on the photoreceptor, employing a modulated beam which is modulated using digital image data from computers.

In recent years, in the field such as electro photography in which electrostatic latent images are formed on a photoreceptor drum and the resulting latent images are developed to form visible images, increasingly carried have been research and development of image forming methods, utilizing a digital system, in which improvements of image quality, conversion, and edition are easily achieved and it is possible to form high quality images.

There are an apparatus in which as a scanning optical system which is subjected to light modulation, employing digital image signals from a computer employed in the aforesaid image forming method and apparatus or copying original documents, an acoustic optical modulator is interposed in a laser optical system and light modulation is achieved by the aforesaid acoustic optical modulator, and an apparatus in which laser intensity is subjected to direct modulation employing semiconductor lasers. Spot exposure is carried out onto a uniformly charged photoreceptor from these scanning optical systems, and images comprised of dots are formed.

A beam emitted from the aforesaid scanning optical system results in a circular or elliptical luminance distribution analogous to the normal distribution with longer extent on both sides. For example, in the case of laser beams, the resulting distribution in either the primary scanning direction or the secondary scanning direction, or both is circular or elliptical, which has an extremely narrow width such as 20 to 100 μm.

(5) Cleaning Means and Other Structures

It is preferable that cleaning is carried out employing a blade cleaning system which employs elastic rubber blades as a member. Employed as elastic rubber may be urethane rubber and silicone rubber. Of these, urethane rubber is particularly preferred.

When image forming apparatuses are employed as copiers and printers, image exposure is performed as follows. A photoreceptor is exposed to light reflected from or transmitted through an original document. Alternatively, an original document is read employing a sensor and the resulting reading is converted to signals. Based on the signals, a laser beam is scanned, an LED array is driven, or a liquid crystal array is driven. By so doing, a photoreceptor is exposed imagewise to light.

When employed as printers of facsimile machines, image exposure unit 13 performs exposure to print receiving data.

It is possible to apply the image forming apparatus of the present invention to general electrophotographic apparatuses such as copiers, laser printers, LED printers, and liquid crystal shutter type printers. It is also possible to apply the same widely to displays, recording, shortrun printing, plate making, and facsimiles to which electrophotographic techniques are applied.

EXAMPLES

The examples of the present invention will now be described.

Example 1

Preparation of Photoreceptor 1

A semi-conductive layer, having a dried layer thickness of 15 μm, was formed by applying the coating composition prepared as described below onto a cylindrical drawn aluminum substrate having a drum diameter of 30 mm.

<Coating Composition of Semi-Conductive Layer (PCL)>

| | |
|---|---|
| Phenol resin | 160 g |
| Conductive titanium oxide | 200 g |
| Methyl cellosolve | 100 ml |

Subsequently, the interlayer coating composition described below was prepared. The resulting coating composition was applied onto the aforesaid conductive layer, employing a dip coating method, and a 1.0 μm thick interlayer was formed.

<Coating Composition of Inter Layer (UCL)>

| | |
|---|---|
| Polyamide resin (Amilan CM-8000, manufactured by Toray Industries Inc.) | 60 g |
| Methanol | 1600 ml |
| 1-Butanol | 400 ml |

Further, the composition prepared as described below was dispersed for 10 hours employing a sand mill, whereby a charge generating layer coating composition was prepared. The resulting composition was applied onto the aforesaid interlayer, employing a dip coating method, whereby a 0.2 μm thick charge generating layer was formed.

<Charge Generating Layer (CGL) Composition>

| | |
|---|---|
| Y type tintanyl phthalocyanine | 60 g |
| Silicone resin solution (KR5240, 15 percent xylene-butanol solution, manufactured by Shin-Etsu Kagaku Co.) | 700 g |
| 2-Butanone | 2000 ml |

Finally, the components described below were mixed and dissolved, whereby a charge transport layer coating composition was prepared. The resulting composition was applied onto the aforesaid charge generating layer, employing a dip coating method, whereby a 20 μm thick charge transport layer was prepared. Thus, Photoreceptor 1 was prepared.

<Charge Transport Layer (CTL) Coating Composition>

| | |
|---|---|
| Charge transport material | 200 g |
| Bisphenol Z type polycarbonate (Iupilon Z300, manufactured by Mitsubishi Gas Kagaku Co.) | 300 g |
| 1,2-Dichloroethane | 2000 ml |

Preparation of Photoreceptor 2

The interlayer coating composition described below was applied onto a aluminum substrate, having a drum diameter of 30 mm and subsequently dried at 150° C. for 30 minutes, whereby a 1.0 μm thick interlayer was formed.

<Interlayer (UCL) Coating Composition>

| | |
|---|---|
| Zirconium chelate compound ZC-540 (manufactured by Matsumoto Seiyaku Co.) | 200 g |
| Silane coupling agent KBM-903 (manufactured by Shin-Etsu Kagaku Co.) | 100 g |
| Methanol | 700 ml |
| Ethanol | 300 ml |

Subsequently, the components described below were mixed, and the resulting mixture was dispersed for 10 hours, employing a sand mill, whereby a charge generating layer coating composition was prepared. The resulting coating composition was applied onto the aforesaid interlayer, employing a dip coating method, whereby a 0.2 μm thick charge generating layer was formed.

<Charge Generating Layer (CGL) Coating Composition>

| | |
|---|---|
| Y type tintanyl phthalocyanine | 60 g |
| Silicone resin solution (KR5240, 15 percent xylene-butanol solution, manufactured by Shin-Etsu Kagaku Co.) | 700 g |
| 2-Butanone | 2000 ml |

Further, the charge transport layer coating composition described below was prepared. The resulting coating composition was applied onto the aforesaid charge generating layer, whereby a 20 μm thick charge transport layer was formed. Thus, Photoreceptor 2 was prepared.

<Charge Transport Layer (CTL) Coating Composition>

| | |
|---|---|
| Charge transport material | 200 g |
| Bisphenol Z type polycarbonate (Iupilon Z300, manufactured by Mitsubishi Gas Kagaku Co.) | 300 g |
| 1,2-Dichloroethane | 2000 ml |

Preparation of Photoreceptor 3

A protective layer coating composition was prepared by mixing and dissolving the components described below, and was applied onto the charge transport layer of Photoreceptor 2.

<Protective Layer (OCL) Coating Composition>

Added to 10 parts by weight of a polysiloxane resin comprised of 80 mol percent of methylsiloxane units and 20 mol percent of methyl-phenylsiloxane units was molecular sieve 4A. The resulting mixture was allowed to stand for 15 hours and was subjected to dehydration. The resulting resin was dissolved in 10 parts by weight of toluene and was added with 5 parts by weight of methyltrimethoxysilane and 0.2 part by weight of dibutyl tin acetate so as to form a solution. Added to the resulting solution were 6 parts by weight of dihydroxymethyltriphenylamine and dissolved. The resulting solution was coated to form a protective layer having a dried layer thickness of 2 μm, which was then subjected to thermal curing at 120° C. for one hour. Thus Photoreceptor 3 was prepared.

Preparation of Photoreceptor 4

An interlayer having a dried layer thickness of 2 μm was formed by applying the interlayer coating composition described below onto an aluminum substrate having a drum diameter of 30 mm, employing a dip coating method.

<Interlayer (UCL) Coating Composition>

The interlayer dispersion, described below, was diluted by a factor of two employing the same solvent mixture. After allowing to stand overnight, the resulting dispersion was filtered (employing Rigimesh Filter, manufactured by Nihon Pall Ltd., having a nominal filtration accuracy of 5 micron under a pressure of 5N/cm$^2$), whereby an interlayer coating composition was prepared.

(Preparation of Interlayer Dispersion)

| | |
|---|---|
| Polyamide resin CM8000 (manufactured by Toray Co.) | 1.0 part by weight |
| Titanium oxide SMT500SAS (manufactured by TAYCA Corp., being subjected to a surface treatment consisting of a silica treatment, an alumina treatment, and a methylhydrogenpolysiloxane treatment) | 3.0 parts by weight |
| Methanol | 10 parts by weight |

were dispersed for 10 hours employing a sand mill.

Subsequently, a charge generating layer coating composition was prepared by mixing the composition described below and dispersing the resulting mixture employing a sand mill. The resulting coating composition was applied onto the aforesaid interlayer, employing a dip coating method, whereby a charge generating layer having a dried layer thickness of 0.3 μm was formed.

<Charge Generating Layer (CGL) Coating Composition>

| | |
|---|---|
| Y type oxytitanyl phthalocyanine (having 27.3 degrees of maximum peak angle of X-ray diffraction using CU-Kα characteristic X-ray in terms of 2θ) | 20 g |
| polyvinyl butyral (#6000-C, manufactured by Denki Kagaku Kogyo Co.) | 10 g |
| t-Butyl acetate | 700 g |
| 4-methoxy-4-methyl-2-pentanone | 300 g |

Further the composition described below was mixed and a charge transport layer coasting composition was prepared. The resulting composition was applied onto the aforesaid charge generating layer, employing a dip coating method, whereby a 24 μm thick charge transport layer was formed.

<Charge Transport Layer (CTL) Coating Composition>

| | |
|---|---|
| Charge transport material | 75 g |
| Polycarbonate resin "Iupilon-Z300" (manufactured by Mitsubishi Gas Kagaku Co.) | 100 g |
| Dioisolane/toluene (mixing mol ratio of 10/1) | 750 g |

2. Removal Method of Coating Layer

A. <Use of Removal Tape>

Removal Method A-1

Wiping-off tape and a photoreceptor drum were installed in the coating layer removal apparatus shown in FIG. 7(*b*). The wiping tape impregnated with solvents was brought into contact with 10 mm wide coating layer from the edge of the photoreceptor drum which rotated at a rate of 5 to 30 rpm, while keeping an inclination angle of 1.0 degree. Subsequently, under such a contact state, the wiping tape was allowed to move at a moving rate of 500 to 3,000 mm/minute in the opposite direction with respect to the rotation direction of the photoreceptor drum, until the coating layer was removed. Thus the coating layer was removed.

The wiping-off tape was brought into pressure contact with 15 percent of the circumference of the photoreceptor drum, employing two pressure rollers, while tension of 25 N/20 mm width was applied between the master roll and the winding roll.

Removal Method A-2

Removal was performed in the same manner as aforesaid Removal Method A-1 of the coating layer, except that the inclination angle was varied to 0.0 degree.

B. <Use of Brush>

Removal Method B-1

An electrophotographic photoreceptor was produced so as to form an approximately 1 cm non-coated portion in the upper edge and was transported to a coating layer removal process. Series of operations, as described for FIG. 8, was then performed and a 1 cm wide coating layer in the lower edge was removed. The resulting photoreceptor was transported to the subsequent drying process whereby a finished photoreceptor was prepared. Employed as solvents in the solvent tank of the coating layer removing apparatus was methylene chloride which was the same as the charge transport layer. A 0.5 mm polyester brush, employed as a rubbing member of the coating layer removing stand, rotated, and the residual solvent ratio in the edge of the coating layer at the start of the coating layer removal was set at 12.0 percent (percent by weight, in which the solvent amount in the coating composition was 100 percent by weight).

Removal Method B-2

The same polyester brush as Removing Method B-1 was employed as a rubbing member. However, during removing the coating layer, the coating layer removing stand was dipped in the solvent tank as described in Example 1 of Japanese Patent Application Open to Public Inspection No. 5-142789 and the lower edge of the coating layer was peeled off.

The aforesaid four types of Photoreceptors 1 through 4 and Removal Methods A-1, A-2, B-1, and B-2 were combined as shown in Table 1, and peeling was carried out in each combination.

Table 1 shows the results.

TABLE 1

| Drum No. | Example/ Comparative Example | Photo-Receptor No. | Removal Method | Used Solvent | Unevenness in Lateral Direction (mm) | P (μm) | Pmax-P (μm) | (Pmax/D) × 100 | Edge Removal State |
|---|---|---|---|---|---|---|---|---|---|
| 1 | Example 1 | 1 | A-1 | *1 | Less than 2 | 20 | 7 | 3 | good |
| 2 | Example 2 | 2 | A-1 | *1 | Less than 2 | 15 | 8 | 20 | good |
| 3 | Example 3 | 3 | A-1 | *1 | Less than 2 | 30 | 20 | 10 | good |
| 4 | Example 4 | 4 | A-1 | *2 | Less than 2 | 25 | 21 | 5 | good |
| 5 | Example 5 | 1 | B-1 | *1 | Less than 2 | 22 | 18 | 40 | good |
| 6 | Example 6 | 2 | B-1 | *1 | Less than 2 | 16 | 0 | 10 | good |
| 7 | Example 7 | 3 | B-1 | *1 | Less than 2 | 26 | 19 | 10 | good |
| 8 | Example 8 | 4 | B-1 | *2 | Less than 2 | 20 | 3 | 3 | good |
| 9 | Comparative Example 1 | 2 | A-2 | *2 | About 4 | 16 | 20 | 20 | *3 |
| 10 | Comparative Example 2 | 3 | A-2 | *2 | About 4 | 26 | 8 | 20 | *4 |
| 11 | Comparative Example 3 | 3 | B-2 | *2 | About 4 | 26 | 12 | 55 | *5 |

*1; methanol/methylene chloride = 1/1
*2; methanol/dioxolane 1/1
*3; the edge tends to be removed due to large projection
*4; a thin layer portion in the edge is long, and the portion tends to be peeled off
*5; the cut edge is steep and tends to be peeled off
*Unevenness in the lateral direction: difference between the maximum value and the minimum value of indentation caused by removal in the circumferential direction when the drum is viewed from above Evaluation (Contact Charging Roller)

<Evaluation Conditions>

The corona charging unit of a digital copier Konica 7033, manufactured by Konica Corp., was replaced with the roller charging unit, described below, and the copying rate was modified to ten A4 sheets/minute. By employing the aforesaid copier, practical printing was performed and evaluated. Conditions are described below.

(Charging Roller)

The charging roller was used which comprised an 8 mm diameter stainless steel rod having thereon the conductive elastic member and the like.

Charging Roller No. 1

A composition for the conductive elastic body layer was prepared by mixing polynorbonane rubber/carbon black/naphthene based oil and, if desired, vulcanizing agents, vulcanization accelerators, and other additives. The resulting composition was filled in a molding die and the conductive elastic body layer was molded. Subsequently, a composition comprised of polyester urethane, resinous powder having a particle diameter of approximately 0.5 μm, carbon black, and solvents (methyl ethyl ketone/dimethylformamide) was prepared as a cover layer forming material. The aforesaid eclectically conductive elastic body layer was dipped in and coated with the aforesaid cover forming material composition. The resulting coating was dried and thermally processed to form a cover layer comprised of a urethane layer. Thus, Charging Roller No. 1 was prepared.

Charging Roller No. 2

Charging Roller No. 2 was prepared in the same manner as Charging Roller No. 1, except that as the cover layer forming material, the resinous powder having a particle diameter of approximately 0.5 μm was replaced with resinous powder having a particle diameter of approximately 8 μm.

Charging Roller No. 3 was prepared in the same manner as Charging Roller No. 1, except that as the cover layer forming material, the resinous powder having a particle diameter of approximately 0.5 μm was replaced with resinous powder having a particle diameter of approximately 12 μm.

The surface roughness Rz of each of the obtained charging rollers was determined employing a surface roughness meter (Surfcom-550A, manufactured by Tokyo Seimitsu Co.). Table 2 shows the results.

Measurement Conditions

Pickup: 0.2

Stylus: 0.8

Cut-off: 0.8

Measurement distance: 4 mm

Measurement rate: 0.3/second

TABLE 2

| Charging Roller No. | Rz |
|---|---|
| 1 | 0.1 |
| 2 | 7.0 |
| 3 | 9.5 |

Charging Conditions

Photoreceptor contact pressure: 500 mN/cm

Direct current voltage applied to charging member: −600 V

Alternative current voltage: 2,000 Vp-p (frequency: 150 Hz)

Development Conditions

DC bias: −500 V

Dsd (distance between the photoreceptor and the development sleeve): 600 μm

Developer layer regulation: magnetic H-Cut system

Developer layer thickness: 700 μm

Development sleeve diameter: 40 mm

In addition, heating roller fixing was employed as a fixing method and non-transfer toner which remained on the photoreceptor was removed employing a method utilizing urethane rubber.

Paper having a basis weight of 55 kg was used as transfer paper.

Each of the combinations of photoreceptors and charging rollers shown in Table 3 below was installed in the aforesaid modified digital copier Konica 7033, manufactured by Konica Corp., and 10,000 A4 sheets was subjected to image printing at normal temperature and normal humidity (20° C. and relative humidity 60 percent). Subsequently evaluation was performed. Table 3 shows the results.

(1) Evaluation

Evaluation was carried out at the start and every 5000th sheet until printing 10,000 sheets. When required to use a densitometer, "RD-918" (manufactured by Macbeth Corp.) was used.

Image Unevenness:

Evaluated by halftone image density difference (ΔHD=density of 1 cm portion in the edge−density of central portion)

A: less than or equal to 0.05 (good)

B: more than 0.05 to less than 0.1 (commercially viable level)

C: more than 0.1 (commercially unviable)

Black Spots

A: the number of 0.4 mm or larger black spots: 3 or less/A4 in all image prints

B: the number of 0.4 mm or larger black spots: formation of at least one sheet having 4 or less to 19 or less/A4 (commercially viable level)

C: the number of 0.4 mm or larger black spots: formation of At least one sheet having 20 or more/A4 (commercially unviable level)

Layer Peeling in Edge:

After completion of continuous printing, the photoreceptor edges were observed and photosensitive layer peeling at the edge was inspected.

A: no layer peeling at the edge was noticed

B: slight layer peeling at the edge was noticed but was commercially viable

C: layer peeling at the edge was noticed and was commercially unviable

Toner Stain

After printing 10,000 the image forming apparatus and the photoreceptor surface were observed and toner stain was inspected.

A: no toner scattering was noticed

B: slight toner scattering was noticed but was in the commercially viable level

C: toner scattering was noticed and was in the commercially unviable level

Charging Roller State after Printing 10,000 Sheets:

The charging roller was removed and was visually inspected. Table 3 shows the results.

TABLE 3

| Example/ Comparative Example | Charging Roller No. | Image Unevenness | Toner Stain | Black Spots | Layer Peeling at Edges | *1 |
|---|---|---|---|---|---|---|
| Example 1 | 1 | A | A | A | A | good |
| Example 2 | 1 | A | A | A | A | good |
| Example 3 | 1 | A | A | A | A | good |
| Example 4 | 2 | A | A | A | A | good |
| Example 5 | 2 | A | A | A | A | good |
| Example 6 | 2 | A | A | A | A | good |
| Example 7 | 3 | A | A | A | A | good |
| Example 8 | 3 | A | A | A | A | good |
| Comparative Example 1 | 1 | C | C | C | *2 | |
| Comparative Example 2 | 1 | C | C | B | B | good |
| Comparative Example 3 | 1 | C | C | C | C | *3 |

*1; Charging Roller State after Printing 10,000 Sheets

*2; the edge was damaged and the resulting damage extended to the image portion.

*3; the edge was damaged and the resulting damage extended to the image portion.

As can clearly be seen from Table 3, Examples according to the present invention exhibited excellent characteristics such that image unevenness, toner stain, black spots and layer peeling at the edge were minimized and the desired durability of the charging roller was achieved.

Example 2

A corona charging unit in a digital copier Konica 7033, manufactured by Konica Corp. was replaced with a magnetic brush charging unit. In addition, the printing rate was modified to 10 A4 sheets/minute. Thereafter, practical printing evaluation was performed. Conditions other than charging conditions were the same as the aforesaid charging roller.

(Magnetic Brush Charging Unit)

A magnetic brush structured as shown in FIG. 13 was used.

Preparation of Magnetic Particles

Magnetic particles, which form the charging magnetic brush, were prepared as described below.

Preparation of Magnetic Particles 1

$Fe_2O_3$: 50 mol percent

CuO: 24 mol percent

ZnO: 24 mol percent

Above components were ground and mixed. The resulting mixture was added with dispersing agents, binders, and water so as to form slurry. Thereafter, the resulting slurry was subjected to granulation, employing a spray dryer. The resulting granules were classified and subsequently baked at 1,125° C. The obtained magnetic particles were subjected to a cracking treatment. Thereafter, classification was carried out, whereby Magnetic Particles 1 having a volume average diameter of 27 μm was obtained. Resistance of the resulting magnetic particles was $2\times10^7$ Ω·cm.

Preparation of Magnetic Particles 2

Added to 100 parts by weight of aforesaid Magnetic Particles 1 were 0.05 part by weight of a titanium coupling agent (isoproxytriisostearoyl titanate) and methyl ethyl ketone. The resulting mixture was stirred and an organic layer was formed on the surface of magnetic particles. Thereafter, magnetic particles were separated and the separated magnetic particles were heated and dried at 180° C., whereby Magnetic Particles 2, having a volume average diameter of 37 μm, was obtained. Resistance of the resulting magnetic particles was $2\times10^7$ Ω·cm.

Preparation of Magnetic Particles 3

Magnetic Particles 3, comprised of magnetite ($FeO.Fe_2O_3$), having a volume average particle diameter of 35 μm, was employed.

Preparation of Magnetic Particles 4

$Fe_2O_3$: 50 mol percent

MnO: 30 mol percent

MgO: 20 mol percent

Above components were ground and mixed. The resulting mixture was added with dispersing agents, binders, and water so as to form slurry. Thereafter, the resulting slurry was subject to granulation, employing a spray dryer. The resulting granules were classified and subsequently, in order to regulate resistance, baked at 1,130° C. in an ambience in which oxygen concentration was adjusted. The obtained magnetic particles were subjected to a cracking treatment. Thereafter, classification was carried out, whereby Magnetic Particles 4, having a volume average diameter of 70 μm, was obtained. Resistance of the resulting magnetic particles was $9\times10^5$ Ω·cm.

TABLE 4

| Magnetic Particles No. | Average Particle Diameter (μm) | Ratio of Particles Having a Diameter of 1/2 Times or Less (%) | Resistivity (Ω · cm) | Intensity of Magnetization (emu/g) |
|---|---|---|---|---|
| 1 | 27 | 24.2 | $2\times10^{-7}$ | 65 |
| 2 | 37 | 26.3 | $2\times10^{-7}$ | 70 |
| 3 | 35 | 15.0 | $2\times10^{-6}$ | 60 |
| 4 | 70 | 25.0 | $2\times10^{-5}$ | 63 |

Measurement Method of Volume Average Particle Diameter of Magnetic Particles

It is possible to measure the volume average particle diameter of a carrier, employing a laser diffraction type particle size distribution measurement apparatus "HELOS", (manufactured by SYMPATEC Co.), equipped with the aforesaid wet type homogenizer as a representative apparatus.

Measurement Method of Ratio of Particle Diameter Having ½ Times or Less Number Average Particle Diameter of Magnetic Particles A volume particle size distribution is measured employing the aforesaid laser diffraction type particle size measurement apparatus "HELOS", equipped with a wet type homogenizer, and the resulting distribution is converted to a number particle size distribution. Subsequently the ratio of particle diameter having ½ times or less number average particle diameter was obtained.

Measurement Method of Resistivity (Ω·cm)

Magnetic particles are placed in a container, having a cross-sectional area of 0.50 $cm^2$, and tapped. Subsequently, a 1 $kg/cm^2$ load is applied onto the filled particles. The resistivity is obtained by reading current values when voltage is applied between the load and the bottom surface electrode so as to generate a 1,000 V/cm electric field.

Charging Conditions

Charging sleeve: stainless steel having a 10 mm diameter

Voltage applied to the charging sleeve: direct current voltage 450 V superimposed by alternative current voltage Magnetic particle amount in the charging region: 250 $mg/cm^2$ Linear rate ratio of charging sleeve/photoreceptor: 0.8

Each of the combinations of toners (developers), photoreceptors, and magnetic brushes employing magnetic particles was installed in the aforesaid modified digital copier Konica 7033, manufactured by Konica Corp., and evaluation was carried out by image-printing 10,000 sheets at normal temperature and normal humidity (20° C. and 60 percent relative humidity).

Evaluation was carried out employing the same methods as the aforesaid charging roller.

TABLE 5

| Example/ Comparative Example | Magnetic Particles No. | Toner Stain | Black Spots | Layer Peeling at Edges | Image Unevenness due to Degradation of Magnetic particles |
|---|---|---|---|---|---|
| Example 1 | 1 | A | A | A | A |
| Example 2 | 1 | A | A | A | A |
| Example 3 | 1 | A | A | A | A |
| Example 4 | 2 | A | A | A | A |
| Example 5 | 2 | A | A | A | A |
| Example 6 | 3 | A | A | A | A |
| Example 7 | 3 | A | A | A | A |
| Example 8 | 4 | A | A | A | A |
| Comparative Example 1 | 1 | C | C | C | C |
| Comparative Example 2 | 1 | B | B | B | C |
| Comparative Example 3 | 1 | C | C | C | C |

As can clearly be seen from Table 5, in Examples according to the present invention, image problems were minimized, the degradation of magnetic particles was also minimized, and excellent images were obtained.

Example 3

Toners and Developers

Preparation of Toners and Developers (Toner Production Example 1: Example of Emulsion Polymerization Coalescence Method)

Charged into a vessel were 0.90 kg of sodium n-dodecylsulfate and 10.0 liters of pure water. The resulting mixture was stirred and dissolved. Gradually added to the resulting solution was 1.20 kg of Regal 330R (carbon black manufactured by Cabot Corp.) and the resulting mixture was well stirred over one hour, and subsequently was continuously dispersed for 20 hours, employing a sand grinder (a medium type homogenizer). The resulting dispersion was designated as "Colorant Dispersion 1".

Further, a solution consisting of 0.055 kg of sodium dodecybenznesulfonate and 4.0 liters of ion-exchange water was designated as "Anionic Surface Active Agent Solution A".

A solution consisting of 0.014 kg of nonylphenolpolyethylene oxide 10 mol addition product and 4.0 liters of ion-exchange water was designated as "Nonionic Surface Active Agent Solution B".

A Solution prepared by dissolving 223.8 g of potassium persulfate in 12 liters of ion-exchange water was designated as "Initiator Solution C".

Added to a capacity 100-liter GL (glass lining) reaction vessel fitted with a thermal sensor, a cooling pipe, and a nitrogen inlet apparatus were 3.41 kg of WAX emulsion (polypropylene emulsion having a number average molecular weight of 3,000, a number average primary particle diameter of 120 nm, and a solid concentration of 29.9 percent), all "Anionic Surface Active Agent Solution A", and all "Nonionic Surface Active Agent Solution", and the resulting mixture was stirred. Subsequently 44.0 liters of ion-exchange water were added.

The resulting mixture was heated to 75° C. and all "Initiator Solution C" was dripped. Thereafter, while maintaining the temperature at 75±1° C., 12.1 kg of styrene, 2.88 kg of n-butyl acrylate, 1.04 kg of methacrylic acid, and 548 g of t-dodecylmercaptan were added while being dripped. After the addition, temperature in the vessel was raised to 80±1° C. and stirring was continued for 6 hours while maintaining the temperature. Subsequently, the temperature was lowered to 40° C. or less, and stirring was terminated. Filtration was then carried out employing a Pall filter, whereby latex was obtained. The resulting latex was designated as "Latex A".

Incidentally, glass transition temperature and softening point of resinous particles in Latex A were 57° C. and 121° C., respectively. With regard to their molecular weight distribution, the weight average molecular weight was 12,700 and the weight average particle diameter was 120 nm.

A solution prepared by dissolving 0.055 kg of sodium dodecylbenzenesulfonate in 4.0 liters of ion-exchange water was designated as "Anionic Surface Active Agent Solution D".

Further, a solution prepared by dissolving 0.014 kg of nonylphenolpolyethylene oxide 10 mol addition product in 4.0 liters of ion-exchange water was designated as "Nonionic Surface Active Agent Solution E".

A solution prepared by dissolving 200.7 g of potassium persulfate (manufactured by Kanto Kagaku Co.) in 12.0 liters of ion-exchange water was designated as "Initiator Solution F".

Added to a capacity 100-liter GL reaction vessel fitted with a thermal sensor, a cooling pipe, a nitrogen inlet apparatus, and a comb shaped baffle were 3.41 kg of WAX emulsion (polypropylene emulsion having a number average molecular weight of 3,000, a number average primary particle diameter of 120 nm, and a solid concentration of 29.9 percent), all "Anionic Surface Active Agent Solution D", and all "Nonionic Surface Active Agent Solution E", and the resulting mixture was stirred.

Subsequently 44.0 liters of ion-exchange water were added. The resulting mixture was heated to 70° C. and all "Initiator Solution F" was added. Subsequently, a solution which has been prepared by mixing 11.00 kg of styrene, 4.00 kg of n-butyl acrylate, 1.04 kg of methacrylic acid, and 9.02 g of t-dodecylmercaptan were added dropwise. After completion of dripping, temperature in the vessel was adjusted to 72±1° C. and stirring was continued for 6 hours while maintaining the temperature. Subsequently, the temperature was raised to 80±2° C. and stirring was carried out for 6 hours while maintaining the temperature. The temperature in the vessel was lowered to 40° C. or less, and stirring was terminated. Filtration was then carried out employing a Pall filter. The resulting filtrate was designated as "Latex B".

Incidentally, the glass transition temperature and softening point of resinous particles in Latex B were 58° C. and 132° C., respectively. With regard to their molecular weight distribution, the weight average molecular weight was 24,500 and the weight average particle diameter was 110 nm.

A solution prepared by dissolving 5.36 kg of sodium chloride as a slating-out agent in 20.0 liters of ion-exchange water was designated as "Sodium Chloride Solution G".

A solution prepared by dissolving 1.00 g of a fluorine based nonionic surface active agent in 1.00 liter of ion-exchange water was designated as "Nonionic Surface Active Agent Solution H".

While stirring, added to a 100-liter SUS reaction vessel fitted with a thermal sensor, a cooling pipe, a nitrogen inlet apparatus, and a particle diameter and shape monitoring apparatus were 20.0 kg of Latex A, 5.2 kg of Latex B, and 0.4 kg of Colorant Dispersion, which were prepared as above, and 20.0 kg of ion-exchange water. Subsequently, the resulting mixture was heated to 40° C., and Sodium Chloride Solution G, 6.00 kg of isopropanol (manufactured by Kanto Kagaku Co.), and Nonionic Surface Active Agent Solution G were added in the stated order. Thereafter the resulting mixture was allowed to stand for 10 minutes and the temperature of the composition was raised to 85° C. over 60 minutes. While maintaining at 85±2° C., stirring was carried out for 0.5 to 3 hours, and particles were allowed to grow under salting-out/fusion. Subsequently, by adding 2.1 liters of pure water, particle growth was terminated, whereby fused particle dispersion was prepared.

Charged into a 5-liter reaction vessel fitted with a thermal sensor, a cooling pipe, and a particle diameter and shape monitoring apparatus was 5.0 kg of the fused particle dispersion prepared as above. While maintain the temperature of the resulting mixture at 85±2° C., particle shape was controlled while stirring for 0.5 to 1.5 hours at 85±2° C. Thereafter, the resulting product was cooled to 40° C. or less and stirring was then terminated. Subsequently, by employing a centrifuge, classification was carried out in liquid, utilizing a centrifugal sedimentation method. The resulting product was filtered employing an opening 45 μm sieve. The resulting filtrate was designated as a coalesce composition. Subsequently, employing a Nutsche, a wet cake-shaped non-spherical particles were collected through filtration. Thereafter, they were washed with ion-exchange water. The resulting non-spherical particles were dried at an inlet-air temperature of 60° C., employing a flash jet dryer, and subsequently dried at 60° C., employing a fluidized-bed dryer. Externally added to 100 parts by weight of the obtained colorant particles was one part by weight of fine silica particles, employing a Henschel mixers, whereby toner prepared by the emulsion polymerization coalescence method was obtained.

While monitoring the aforesaid salting-out/fusion stage and shape control process, the particle diameter and the variation coefficient of particle size distribution are optionally regulated by controlling the stirring rotation frequency as well a the heating time, and the shape as well a the variation coefficient of shape factor, and further by carrying out classification in liquid. By so doing, Toners 1 through 17 comprised of toner particles having the shape characteristics and the particles size distribution characteristics, shown in Table 6, were obtained.

TABLE 6

| Toner No. | Ratio of Toner Particles Having Shape Factor of 1.2 to 1.6 (%) | Variation Co-efficient of Shape Factor of Toner Particles (%) | Ratio of Toner Particles without Corners (%) | Number Average particle Diameter of Toner Particles (μm) | Number Variation Co-efficient of Toner Particles | $M(m_1 + m_2)$ (%) |
|---|---|---|---|---|---|---|
| 1 | 68.3 | 15.2 | 88 | 5.6 | 25.9 | 80.7 |
| 2 | 73.2 | 12.2 | 94 | 5.7 | 20.7 | 82.3 |
| 3 | 65.1 | 14.8 | 52 | 5.4 | 26.6 | 71.4 |
| 4 | 63.4 | 15.7 | 51 | 5.3 | 26.1 | 70.5 |
| 5 | 67.7 | 16.8 | 53 | 5.6 | 26.5 | 72.4 |
| 6 | 68.2 | 16.9 | 88 | 5.7 | 22.0 | 79.8 |
| 7 | 67.7 | 15.2 | 46 | 5.6 | 25.9 | 80.7 |
| 8 | 74.1 | 12.4 | 89 | 5.7 | 27.8 | 71.6 |
| 9 | 65.1 | 15.0 | 51 | 5.6 | 25.6 | 67.4 |
| 10 | 60.2 | 17.2 | 53 | 5.7 | 25.8 | 70.5 |
| 11 | 66.1 | 16.9 | 42 | 5.7 | 22.0 | 79.8 |
| 12 | 65.1 | 17.7 | 55 | 5.5 | 26.7 | 71.0 |
| 13 | 67.7 | 16.8 | 53 | 5.6 | 26.2 | 68.2 |
| 14 | 62.1 | 15.1 | 40 | 7.7 | 26.0 | 68.2 |
| 15 | 62.5 | 17.2 | 53 | 8.2 | 25.8 | 67.8 |
| 16 | 60.5 | 17.8 | 42 | 5.7 | 26.2 | 68.3 |
| 17 | 61.5 | 18.0 | 44 | 8.8 | 28.4 | 65.3 |

(Production of Developers)

Developers 1 through 17 for evaluation were prepared by mixing 10 parts by weight of each of Toners 1 through 17 with 100 parts by weight of a 45 μm ferrite carrier covered with a styrene-methacrylate copolymer.

<<Performance Evaluation>>

Aforesaid Photoreceptor Drums 1 through 11 as well as Developers 1 through 17 were combined as shown in Table 7. Each of the combinations was evaluated employing a digital copier Konica "Sitios 7075", manufactured by Konica Corp., as a copier for evaluation, (operated by processes comprising corona charging, laser exposure, reversal development, electrostatic transfer, and claw separation blade cleaning, as well as a process utilizing cleaning supplementary brush roller, at a printing rate of 75 sheets/minute). Cleaning properties and images were evaluated by copying an original document having four equal quarter parts of a text having a pixel ratio of 7 percent, a portrait, a solid white image, and a solid black image, employing A4 neutral paper sheets. The aforesaid original document was continuously copied employing 200,000 sheets at high temperature and high humidity (30° C. and 80 percent relative humidity) which were assumed to be the severest conditions, and the resulting halftone, solid white images and solid black images were evaluated. Incidentally, prior to initial printing, the photoreceptor was fitted with the cleaning blade by dusting the photoreceptor surface with setting powder. Thereafter, 200,000 sheets were printed. Evaluation items as well as evaluation criteria are shown below.

Paper sheets having a basis weight of 55 kg were employed as transfer paper.

If desired, "RD-918" (manufactured by Macbeth Corp.) was employed as a densitometer.

Evaluation Items and Evaluation Criteria

Image Unevenness at Edges:

Evaluated by the density difference in halftone images (ΔHD=density of 1 cm portion at the edge−density of the central portion)

A: less than or equal to 0.05 (good)

B: more than 0.05 to less than 0.1 (commercially viable level)

C: more than or equal to 0.1 (commercially unviable)

Black Spots

A: the number of 0.4 mm or larger black spots: 3 or less/A4 in all image prints

B: the number of 0.4 mm or larger black spots: formation of at least one sheet having 4 or more to 19 or less/A4 (commercially viable level)

C: the number of 0.4 mm or larger black spots: formation of At least one sheet having 20 or more/A4 (commercially unviable level)

Layer Peeling at Edges:

After completion,of continuous printing, the photoreceptor edges were observed and photosensitive layer peeling at the edges was inspected.

A: no layer peeling at edges was noticed

B: slight layer peeling at edges was noticed but was commercially viable

C: layer peeling at edges was noticed and was commercially unviable

Toner Stain

After printing 10,000 sheets, the image forming apparatus and the photoreceptor surface were observed and toner stain was inspected.

A: no toner scattering was noticed

B: slight toner scattering was noticed but was in the commercially viable level

C: toner scattering was noticed and was in the commercially unviable level

TABLE 7

| Combination No. | Photoreceptor Drum No. | Developer (Toner) No. | Image Unevenness at Edges | Toner Stain | Image Problem | Peeling at Edges |
|---|---|---|---|---|---|---|
| 1 | 1 | 1 | A | A | A | A |
| 2 | 2 | 1 | A | A | A | A |

TABLE 7-continued

| Combination No. | Photoreceptor Drum No. | Developer (Toner) No. | Image Unevenness at Edges | Toner Stain | Image Problem | Peeling at Edges |
|---|---|---|---|---|---|---|
| 3 | 3 | 1 | A | A | A | A |
| 4 | 4 | 1 | A | A | A | A |
| 5 | 5 | 1 | A | A | A | A |
| 6 | 6 | 1 | A | A | A | A |
| 7 | 7 | 1 | A | A | A | A |
| 8 | 8 | 1 | A | A | A | A |
| 9 | 9 | 1 | C | B | C | C |
| 10 | 10 | 1 | C | C | B | C |
| 11 | 11 | 1 | C | B | C | C |
| 12 | 7 | 2 | A | A | A | A |
| 13 | 7 | 3 | A | A | A | A |
| 14 | 7 | 4 | A | A | A | A |
| 15 | 7 | 5 | A | A | A | A |
| 16 | 7 | 6 | A | A | A | A |
| 17 | 7 | 7 | A | A | A | A |
| 18 | 7 | 8 | A | A | A | A |
| 19 | 7 | 9 | A | A | A | A |
| 20 | 7 | 10 | A | A | A | A |
| 21 | 7 | II | A | A | A | A |
| 22 | 7 | 12 | A | A | A | A |
| 23 | 7 | 13 | A | A | A | A |
| 24 | 7 | 14 | A | A | A | A |
| 25 | 7 | 15 | A | A | A | A |
| 26 | 7 | 16 | A | A | A | A |
| 27 | 7 | 17 | C | B | C | C |
| 28 | 9 | 17 | C | C | C | C |

As can clearly be seen from Table 7, the combinations according to the present invention, exhibited excellent characteristics in which image unevenness, toner stain, image problems and layer peeling at edges were minimized.

The present invention is capable of providing an electrophotographic image forming method, image forming apparatus, and a processing cartridge, in which, irrespective of excellent image quality, edges of the photoreceptor coating layer result in no peeling due to sufficient adhesion, toner results in no accumulation, toner filming does not occurs, toner staining does not occur due to scattering of coating layer powder and toner, problems such as black spots do not occur, and excellent durability is exhibited, and an electrophotographic photoreceptor employed in the same.

The invention claimed is:

1. A method of forming a toner image, comprising:

electrically charging a photoreceptor by a charging roller being brought into contact with the photoreceptor, the photoreceptor comprises a photosensitive coating layer on a cylindrical conductive substrate, and Formula (2) are held, $$0>P\text{max}>2P, \qquad \text{Formula 1}$$

$$2\leqq(P\text{max}/D)\times100\leqq50, \qquad \text{Formula 2}$$

wherein P (μm) is the average of the coating layer thickness in central section in the width direction of the photoreceptor, P is in a range of 15-35 μm, Pmax (μm) is average of the maximum value of the layer thickness out of the image forming region, Pmax is in a range of 10 to 60 μm, and D (μm) is average of distance between point, at which said maximum value is obtained, and edge of the coating layer;

imagewise exposing the photoreceptor so that a latent image is formed on the photoreceptor;

developing the latent image with toner so that a toner image is formed on the photoreceptor;

transferring the toner image on an image forming material; and removing a residual toner on the photoreceptor.

2. The method of claim 1, wherein the toner has variation coefficient of shape coefficient being not more than 16 percent.

3. The method of claim 2, wherein the toner has number ratio of toner particles having no corners of 50 percent or more.

4. The method of claim 1, wherein the toner has number ratio of toner particles having a shape coefficient of 1.2 to 1.6 in an amount of at least 65 percent.

5. The method of claim 1, wherein the toner has number ratio of toner particles having no corners being 50 percent or more.

6. The method of claim 1, wherein the toner has sum M of $m_1$ and $m_2$ is at least 70 percent, wherein $m_1$ is the relative frequency of toner particles included in the highest frequency class in a histogram, showing the particle size distribution based on the number of particles, in which, when D (in μm) represents the diameter of a toner particle, natural logarithm lnD is taken as the abscissa and a plurality of classes at an interval of 0.23 is taken as the ordinate, and $m_2$ being the relative frequency of toner particles included in the second highest frequency class in the histogram, and the toner has a number variation coefficient of toner particles of at most 27 percent.

7. The method of claim 1, wherein the toner has number variation coefficient in the toner number size distribution being not more than 27 percent.

8. The method of claim 1, wherein the photoreceptor is prepared by coating a composition comprising a photosensitive material onto the substrate so as to form the coating layer and removing a part of the coating layer.

9. The method of claim 8, wherein a part of the coating layer is removed by making a rubbing means brought into contact with the coating layer.

10. The method of claim 9, wherein the rubbing means is a brush.

11. The method of claim 9, wherein the rubbing means is a tape.

12. The method of 1, wherein the residual toner on said electrophotographic photoreceptor is removed by urethane blade cleaning means.

13. The method of claim 1, wherein the charging roller comprises a conductive elastic layer having a direct current volume resistivity in the range of $10^3$ to $10^7$ Ω·cm.

14. The method of claim 13, wherein the charging roller comprises a surface layer having surface roughness Rz of 0.05 to 10 μm.

15. The method of claim 1, wherein the charging roller comprises a surface layer having surface roughness Rz of 0.05 to 10 μm, and the toner has number variation coefficient in the toner number size distribution being not more than 27 percent.

* * * * *